US009323229B2

(12) United States Patent
Akiyama

(10) Patent No.: US 9,323,229 B2
(45) Date of Patent: Apr. 26, 2016

(54) ELECTRONIC TIMEPIECE AND SATELLITE SIGNAL RECEIVING METHOD OF ELECTRONIC TIMEPIECE

(71) Applicant: Seiko Epson Corporation, Tokyo (JP)

(72) Inventor: Toshikazu Akiyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 57 days.

(21) Appl. No.: 14/476,494

(22) Filed: Sep. 3, 2014

(65) Prior Publication Data

US 2015/0071041 A1 Mar. 12, 2015

(30) Foreign Application Priority Data

Sep. 6, 2013 (JP) ..... 2013-185489
Aug. 5, 2014 (JP) ..... 2014-159744

(51) Int. Cl.
*G04R 20/02* (2013.01)
*G04R 20/04* (2013.01)
*G04G 7/00* (2006.01)

(52) U.S. Cl.
CPC . *G04R 20/04* (2013.01); *G04G 7/00* (2013.01)

(58) Field of Classification Search
CPC ..... G04R 20/02; G04R 20/04; G04G 7/00
USPC ..... 368/47
See application file for complete search history.

(56) References Cited

U.S. PATENT DOCUMENTS 7,457,203 B2 * 11/2008 Nakagawa ..... G01S 19/27 342/357.66
2007/0241959 A1 10/2007 Nakagawa
2009/0180356 A1 * 7/2009 Fujisawa ..... G01S 19/14 368/47
2010/0054087 A1 * 3/2010 Matsuzaki ..... G04R 20/04 368/14
2010/0097896 A1 * 4/2010 Baba ..... G01S 19/14 368/47
2012/0176868 A1 * 7/2012 Matsuzaki ..... G04R 20/04 368/47
2015/0168924 A1 * 6/2015 Kato ..... G04R 20/04 368/47

FOREIGN PATENT DOCUMENTS

JP 10-010251 A 1/1998
JP 2007-271538 A 10/2007
JP 2009-014668 A 1/2009
JP 2010-060456 A 3/2010
JP 2010-243193 A 10/2010
JP 2012-225935 A 11/2012
JP 2014-066551 A 4/2014

* cited by examiner

*Primary Examiner* — Sean Kayes

(57) ABSTRACT

A reception control unit of an electronic timepiece includes a satellite-capturing control unit configured to search for a preferential search satellite more preferentially than the other position information satellites, the preferential search satellite being the position information satellite having a stored satellite number, a reception-state determining unit configured to determine, at timing of an end of the search for the preferential search satellite, whether a number of the captured position information satellites is equal to or larger than a predetermined number; a reception-stop control unit configured to stop a reception processing when the reception-state determining unit determines that the number of the position information satellites is smaller than the predetermined number; and a storage control unit configured to store the satellite number of the captured position information satellite in the satellite-number storing unit.

12 Claims, 18 Drawing Sheets

< CAPTURED SATELLITES >

| PRN | 1 | 3 | 6 | 9 | 12 | 14 | 16 | 20 | 25 |
|---|---|---|---|---|---|---|---|---|---|
| SNR | 20 | 32 | 34 | 35 | 40 | 38 | 35 | 45 | 45 |

FIG. 6A

< SATELLITES TO BE STORED (PREFERENTIAL SEARCH SATELLITES) >

| PRN | 9 | 12 | 14 | 16 | 20 | 25 |
|---|---|---|---|---|---|---|
| SNR | 35 | 40 | 38 | 35 | 45 | 45 |

FIG. 6B

< CAPTURED SATELLITES >

| PRN | 1 | 3 | 6 | 9 | 12 | 14 | 16 | 20 | 25 |
|---|---|---|---|---|---|---|---|---|---|
| SNR | 20 | 32 | 34 | 35 | 35 | 45 | 40 | 38 | 45 |

FIG. 10A

< SATELLITES TO BE STORED (PREFERENTIAL SEARCH SATELLITES) >

| PRN | 14 | 16 | 20 | 25 |
|---|---|---|---|---|
| SNR | 45 | 40 | 38 | 45 |

FIG. 10B

| SATELLITE TYPE | PRN (SATELLITE NUMBER) |
|---|---|
| GPS (GLOBAL POSITIONING SYSTEM) | 1 ~ 32 |
| SBAS (STATIONARY SATELLITE TYPE SATELLITE NAVIGATION REINFORCEMENT SYSTEM) | 120 ~ 138 |
| QZSS (QUASI - ZENITH SATELLITE SYSTEM) | 193 ~ 199 (MICHIBIKI : 193) |

FIG.11

ELECTRONIC TIMEPIECE AND SATELLITE SIGNAL RECEIVING METHOD OF ELECTRONIC TIMEPIECE

BACKGROUND

1. Technical Field

The present invention relates to an electronic timepiece that receives satellite signals transmitted from position information satellites such as GPS satellites and calculates the present date, time, and the like and a satellite signal receiving method of the electronic timepiece.

2. Related Art

An electronic timepiece has been proposed that receives satellite signals transmitted from position information satellites such as GPS (Global Positioning System) satellites and performs time correction (see, for example, JP-A-10-10251 (Patent Literature 1)).

The electronic timepiece of Patent Literature 1 focuses on the fact that the position information satellites are located in substantially the same places at the same time every day, stores a reception history of satellite signals from the position information satellites together with reception times, and, in performing correction of time, selects the position information satellite corresponding to the time and performs reception processing referring to the reception history. Therefore, since the electronic timepiece has to search for only the selected position information satellite, it is possible to reduce a search time and reduce power consumption.

On the other hand, in the electronic timepiece of Patent Literature 1, since it is necessary to create the reception history at every time (an interval of 8 minutes), an information amount to be stored increases and the size of a memory circuit increases. Further, since the position information satellite is selected out of a huge reception history, the reception processing is complicated.

Consequently, it is likely that power consumption increases and the power consumption of the electronic timepiece as a whole cannot be sufficiently reduced.

SUMMARY

An advantage of some aspects of the invention is to provide an electronic timepiece that can reduce power consumption and a satellite signal receiving method of the electronic timepiece.

An aspect of the invention is directed to an electronic timepiece including: a receiving unit configured to capture position information satellites and receive satellite signals transmitted from the captured position information satellites; a satellite-number storing unit configured to store satellite numbers of position information satellites; a generating unit configured to generate generation information on the basis of acquired information acquired from the satellite signals received by the receiving unit; a display unit configured to display the generation information; and a reception control unit configured to control the receiving unit. The reception control unit is a control unit that, during reception processing for receiving the satellite signals, controls the receiving unit, sets a threshold of a reception signal level, and searches for and captures the position information satellites. The reception control unit includes: a satellite-capturing control unit configured to search for, as preferential search satellites, the position information satellites having the satellite numbers stored in the satellite-number storing unit more preferentially than the other position information satellite; a reception-state determining unit configured to determine, at timing of an end of the search for the preferential search satellites for which the threshold of the reception signal level by the satellite-capturing control unit is set to a predetermined value, whether the number of the position information satellites captured by the satellite-capturing control unit is equal to or larger than a predetermined number; a reception-stop control unit configured to control the receiving unit and stop the reception of the satellite signals when the reception-state determining unit determines that the number of the position information satellites is smaller than the predetermined number; and a storage control unit configured to store the satellite numbers of the position information satellites captured by the receiving unit during the reception processing in the satellite-number storing unit.

As the reception processing, for example, there is automatic reception processing for receiving satellite signals when an automatic reception condition is satisfied. As the automatic reception processing, for example, there are regular automatic reception processing and photo-automatic reception processing.

In the regular automatic reception processing, the reception processing is performed at regular time every day.

In the photo-automatic receiving processing, the reception processing is usually performed once a day when it can be determined that the sunlight is irradiated on the electronic timepiece outdoors. Time when a user goes out for work or school is often fixed to a certain degree. Therefore, time when the sunlight is irradiated on the electronic timepiece for the first time in the day is often the same time every day. Therefore, in the case of the photo-automatic reception processing, as in the regular automatic reception processing, the reception processing is often performed at the same time every day.

Since the position information satellites revolve around the Earth once in about 12 hours, the position information satellites are located in substantially the same positions at the same time every day.

Therefore, in the case of the automatic reception processing, since the reception processing is often performed at the same time every day, it is highly likely that the position information satellites captured last time can be captured in the next reception processing.

According to this aspect, the storage control unit stores the satellite numbers of the position information satellites captured by the receiving unit during the reception processing in the satellite-number storing unit. Therefore, the satellite numbers of the position information satellites captured by the receiving unit during the last reception processing are stored in the satellite-number storing unit. During the reception processing, the satellite-capturing control unit accesses the satellite-number storing unit and searches for, as the preferential search satellites, the position information satellites having the satellite numbers stored in the satellite-number storing unit more preferentially than the other position information satellite.

Consequently, when the reception processing is the automatic reception processing, the position information satellites captured during the last reception processing are searched more preferentially than the other position information satellites at time same as time of the last search. Therefore, it is possible to capture the position information satellites early compared with when about thirty position information satellites (GPS satellites) present above the Earth are searched in the order of satellite numbers.

In the case of manual reception processing, as in the automatic reception processing, at time close to time of the last reception processing or time shifted 12 hours from the time of the last reception processing, it is likely that the position information satellites captured last time can be captured in the next reception processing. Therefore, it is possible to reduce an average capturing time compared with when the position information satellites are always searched in the order of satellite numbers during the manual reception processing.

In this way, the position information satellites can be captured early. Therefore, it is possible to succeed in reception of acquired information early and reduce power consumption.

However, for example, when the user performs behavior different from usual behavior and the photo-automatic reception processing is performed at time different from usual time or when the manual reception processing is performed, the user is sometimes present in a period of time when it may be difficult to capture the position information satellite captured during the last reception processing. In this case, in a search period for the preferential search satellites, the acquired information is not successfully received. Therefore, the satellite-capturing control unit performs a search for the other position information satellite.

Time required for the search for the position information satellites is different depending on a value of the threshold. The search time is longer as the threshold is lower. That is, when the threshold is high, only the position information satellites having high reception signal levels are capturing targets. Frequency resolution during the search can be set high. Therefore, time required for the search of all the position information satellites is short and power consumption is small. On the other hand, when the threshold is low, the position information satellites having low reception signal levels are also capturing targets. The frequency resolution during the search needs to be set low. Therefore, time required for the search of all the position information satellites is long and power consumption is large.

In this aspect, the reception-state determining unit sets the threshold of the reception signal level to the predetermined value, performs a search for the preferential search satellites, and, at timing when the search ends, determines whether the number of the captured position information satellites is equal to or larger than the predetermined number. When the reception-state determining unit determines that the number of the captured position information satellites is smaller than the predetermined number, the reception-stop control unit stops the reception of the satellite signals.

Consequently, according to this aspect, effects explained below are obtained by setting the predetermined value to a value with which even the position information satellite having low reception signal levels can be captured but a search time is long and setting the predetermined number to the number of the position information satellites (e.g., three) set as a reference with which reception of the acquired information can be expected. That is, in a time-consuming search, at timing when the search for the preferential search satellites ends, when the position information satellites are not captured by the number with which reception of the acquired information can be expected, a time-consuming search for the other position information satellites is not performed and the reception processing is stopped. Therefore, it is possible to reduce power consumption.

On the other hand, in a search in which the threshold is set to a value higher than the predetermined value, after the preferential search satellites are searched, the other position information satellites are searched without performing the determination of the number of the captured position information satellites.

That is, according to this aspect, in the search with a short search time in which the threshold is set to a value higher than the predetermined value, after the preferential search satellites are searched, the other position information satellites are searched. On the other hand, in the search with a long search time in which the threshold is set to the predetermined value, at the timing when the search for the preferential search satellites ends, if the position information satellites are not captured by the number with which reception of the acquired information can be expected, the search for the other position information satellites is not performed and the reception processing is stopped. Consequently, it is possible to efficiently search for the position information satellites and reduce power consumption.

According to this aspect, in the satellite-number storing unit, the satellite numbers of the position information satellites captured by the receiving unit during the last reception processing only have to be stored. Therefore, it is possible to reduce an information amount to be stored and reduce the size of a memory circuit compared with, for example, when a reception history at every time is stored.

The position information satellites only have to be searched according to the satellite numbers stored in the satellite-number storing unit. Therefore, it is possible to simplify the reception processing compared with, for example, when the reception history at every time is searched through to select an optimum satellite number and search for the position information satellite.

Consequently, it is possible to further reduce power consumption.

In the electronic timepiece according to the aspect, it is preferable that the satellite-capturing control unit sets, after setting the threshold to a first threshold and searching for the position information satellites, the threshold to a second threshold set in the predetermined value having a value lower than the first threshold, and the reception-state determining unit determines, at timing when the search for the preferential search satellites ends in the search by the satellite-capturing control unit in which the threshold is set to the second threshold, whether the number of the position information satellites captured by the satellite-capturing control unit is equal to or larger than the predetermined number.

In this aspect, after setting the threshold to the first threshold and searching for the position information satellites, the satellite-capturing control unit sets the threshold to the second threshold set in the predetermined value having a value lower than the first threshold and searches for the position information satellites.

According to this aspect, if there is a position information satellite having a high reception signal level, it is highly likely that the position information satellite can be captured in a first search in which the threshold is set to the first threshold.

A search time for the position information satellites can be reduced when the threshold is higher. Therefore, according to this aspect, it is possible to capture the position information satellites having high reception signal levels early compared with, for example, when the search is performed with the threshold fixed to the second threshold.

The acquired information can be sequentially received from the captured position information satellites before the search for all the position information satellites ends. A reception success rate for the acquired information is higher in the position information satellites having higher reception signal levels. Therefore, since it is possible to capture the position information satellites having high reception signal levels early, it is possible to succeed in reception of the acquired information earlier.

On the other hand, the position information satellites having low reception signal levels can be captured by the search in which the threshold is set to the second threshold.

In the electronic timepiece according to the aspect, it is preferable that the storage control unit stores, in the satellite-number storing unit, the satellite numbers of the position information satellites having reception signal levels equal to or higher than a predetermined level among the position information satellites captured by the receiving unit during the reception processing.

According to this aspect, the satellite-capturing control unit searches for the position information satellites having reception signal levels equal to or higher than the predetermined level. Therefore, due to setting the predetermined level to the level having high reception success rates of the acquired information, it is possible to efficiently capture the position information satellites having high reception success rates of the acquired information.

Consequently, it is possible to succeed in the reception of the acquired information earlier and further reduce power consumption.

In the electronic timepiece according to the aspect, it is preferable that the storage control unit stores, in the satellite-number storing unit, the satellite numbers of a fixed number of the position information satellites counted from the position information satellite having a highest reception signal level among the position information satellites captured by the receiving unit during the reception processing.

According to this aspect, the satellite-capturing control unit preferentially searches for the position information satellites having high reception signal levels. Therefore, it is possible to efficiently capture the position information satellites having high reception success rates of the acquired information.

Consequently, it is possible to succeed in the reception of the acquired information earlier and further reduce power consumption.

In the electronic timepiece according to the aspect, it is preferable that the storage control unit stores, in the satellite-number storing unit, at timing when the reception of the satellite signals in the receiving unit ends during the reception processing, the satellite numbers of the position information satellites captured by the receiving unit.

The position information satellites that cannot be captured before the reception processing of the satellite signals ends after being once captured by the satellite-capturing control unit are predicted to be located, for example, at the outer edge of a receivable range and are considered to have low reception success rates of the acquired information. According to this aspect, the position information satellites can be excluded from search targets. Therefore, it is possible to efficiently capture the position information satellites having high reception success rates of the acquired information.

In the electronic timepiece according to the aspect, it is preferable that the storage control unit stores, during a fixed time in the reception processing, in the satellite-number storing unit, the satellite numbers of the position information satellites captured by the receiving unit.

According to this aspect, the number of the satellite numbers stored in the satellite-number storing unit increases. Therefore, the number of the position information satellites searched by the satellite-capturing control unit also increases.

Consequently, the number of the position information satellites captured by the satellite-capturing control unit also increases. Therefore, it is possible to improve a reception success rate of the acquired information.

In the electronic timepiece according to the aspect, it is preferable that the satellite-capturing control unit searches for a quasi-zenith satellite in addition to the position information satellites having the satellite numbers stored in the satellite-number storing unit.

The quasi-zenith satellite is a position information satellite that passes over Japan. The quasi-zenith satellite has a high reception success rate of the acquired information in Japan.

According to this aspect, since the quasi-zenith satellite can also be captured, it is possible to improve a reception success rate of the acquired information in Japan.

In the electronic timepiece according to the aspect, it is preferable that the electronic timepiece further includes a nonvolatile memory, and a satellite number of the quasi-zenith satellite is stored in the nonvolatile memory.

According to this aspect, the satellite number of the quasi-zenith satellite can be stored even if electric power is not supplied. Therefore, it is possible to retain the satellite number even when a battery of the electronic timepiece is exhausted.

According to this aspect, data rewriting is possible unlike, for example, a ROM (Read Only Memory). Therefore, when a quasi-zenith satellite is launched anew, it is possible to store a satellite number of the quasi-zenith satellite anew.

Another aspect of the invention is directed to an electronic timepiece including: a receiving unit configured to capture position information satellites and receive satellite signals transmitted from the captured position information satellites; a satellite-number storing unit configured to store satellite numbers of position information satellites; a generating unit configured to generate generation information on the basis of acquired information acquired from the satellite signals received by the receiving unit; a display unit configured to display the generation information; and a reception control unit configured to control the receiving unit. The reception control unit is a control unit that, during reception processing for receiving the satellite signals, controls the receiving unit, sets a threshold of a reception signal level, and searches for and captures the position information satellites. The reception control unit includes: a satellite-capturing control unit configured to search for, as preferential search satellites, the position information satellites having the satellite numbers stored in the satellite-number storing unit more preferentially than the other position information satellites; a first reception-state determining unit configured to determine, at timing of an end of the search for the preferential search satellites for which the threshold of the reception signal level by the satellite-capturing control unit is set to a predetermined value, whether a number of the position information satellites captured by the satellite-capturing control unit is equal to or larger than a predetermined number; a second reception-state determining unit configured to determine whether a number of the position information satellites captured by the satellite-capturing control unit is equal to or larger than a predetermined number at predetermined time intervals; a reception-stop control unit configured to control the receiving unit and stop the reception of the satellite signals when either of the first reception-state determining unit and the second reception-state determining unit determines that the number of the position information satellites is smaller than the predetermined number; and a storage control unit configured to store the satellite numbers of the position information satellites captured by the receiving unit during the reception processing in the satellite-number storing unit.

In this aspect, as in the electronic timepiece, it is possible to achieve the same effect.

According to this aspect, the second reception-state determining unit determines whether the number (the number of captured satellites) of position information satellites captured by the satellite-capturing control unit is equal to or larger than a predetermined number at predetermined time intervals. When the second reception-state determining unit determines that the number of captured satellites is smaller than the predetermined number, the reception-stop control unit controls the receiving unit to stop the reception of the satellite signals.

If only the determination by the first reception-state determining unit is performed, the following is conceivable. That is, when the reception-state determining unit determines that the number of captured satellites is equal to or larger than the predetermined number and the other position information satellites are searched at the timing of an end of the search for the preferential search satellites, the position information satellites which are currently captured cannot be captured. Therefore, even if the number of captured satellites is smaller the predetermined number, the reception processing is continuously performed until the search for the other position information satellites is ended unless acquisition information is received. In other words, it is likely that the reception processing is continuously performed for a long period of time in a state in which reception of acquisition information cannot be expected and thus power is wastefully consumed.

In this aspect, since the predetermined time intervals are appropriately set, when the first reception-state determining unit determines that the number of captured satellites is equal to or larger than the predetermined number and the other position information satellites are currently searched at the timing of an end of the search for the preferential search satellites, the second reception-state determining unit can determine whether the number of captured satellites is equal to or larger than the predetermined number before the search for the other position information satellites ends, and the reception processing can be stopped when the number of captured satellites is smaller than the predetermined number.

For this reason, it is possible to prevent the reception processing from being continuously performed for a long period of time in a state in which reception of acquisition information cannot be expected. Therefore, it is possible to further reduce power consumption.

Preferably, the electronic timepiece according to the aspect further includes an input unit; the reception processing includes automatic reception processing for receiving the satellite signals when an automatic reception condition occurs and manual reception processing for receiving the satellite signals according to an operation of the input unit; and the reception control unit determines whether a number of the position information satellites is equal to or larger than a predetermined number in either of the first reception-state determining unit and the second reception-state determining unit or in both of the first reception-state determining unit and the second reception-state determining unit according to the type of reception processing.

According to this aspect, for example, when the reception processing is the automatic reception processing, determination is performed in both of the first reception-state determining unit and the second reception-state determining unit, and when the reception processing is the manual reception processing, determination is performed only in the second reception-state determining unit.

In the automatic reception processing, as explained above, the first reception-state determining unit determines whether the number of captured satellites is equal to or larger than the predetermined number, and the reception processing is stopped when the number of captured satellites is smaller than the predetermined number. Therefore, it is possible to efficiently search for the position information satellites and to reduce power consumption. The second reception-state determining unit performs determination, and thus it is possible to further reduce power consumption.

On the other hand, in the manual reception processing, there is a time zone in which it is difficult to capture position information satellites which have been captured in the previous reception processing, and, in this case, it is less likely that position information satellites of a predetermined number or more can be captured until the search for the preferential search satellites ends. For this reason, if the first reception-state determining unit performs determination at the timing of an end of the search for the preferential search satellites, it is highly likely that the number of captured satellites is determined as being smaller than the predetermined number, and acquisition information cannot be received and the reception processing is stopped. For this reason, a reception probability of the acquisition information is reduced.

In this aspect, in the manual reception processing, the first reception-state determining unit can be made not to perform determination at the timing of an end of the search for the preferential search satellites. Therefore, the other position information satellites can be searched until at least the determination timing by the second reception-state determining unit arrives after searching for the preferential search satellites. For this reason, it is possible to improve a reception probability of the acquisition information.

As mentioned above, according to this aspect, the determinations by the first reception-state determining unit and the second reception-state determining unit are appropriately selected and performed according to the type of reception processing, and thus it is possible to improve a reception probability of acquisition information while reducing a mean value of power consumption required for the reception processing.

Another aspect of the invention is directed to a satellite signal receiving method of an electronic timepiece including: a receiving unit configured to capture position information satellites and receive satellite signals transmitted from the captured position information satellites; a satellite-number storing unit configured to store satellite numbers of position information satellites; a generating unit configured to generate generation information on the basis of acquired information acquired from the satellite signals received by the receiving unit; a display unit configured to display the generation information; and a reception control unit configured to control the receiving unit. The satellite signal receiving method including: controlling, during reception processing for receiving the satellite signals, the receiving unit, setting a threshold of a reception signal level, and searching for and capturing the position information satellites, the position information satellites having the satellite numbers stored in the satellite-number storing unit being searched as preferential search satellites more preferentially than the other position information satellite; determining, at timing of an end of the search for the preferential search satellites for which the threshold of the reception signal level is set to a predetermined value, whether the number of the captured position information satellites is equal to or larger than a predetermined number; controlling the receiving unit and stopping the reception of the satellite signals when it is determined that the number of the position information satellites is smaller than the predetermined number; and storing the satellite numbers of the position information satellites captured by the receiving unit during the reception processing in the satellite-number storing unit.

In this aspect, as in the electronic timepiece, it is possible to reduce power consumption.

BRIEF DESCRIPTION OF THE DRAWINGS

The invention will be described with reference to the accompanying drawings, wherein like numbers reference like elements.

FIGS. 6A and 6B are diagrams showing an example of a selection method for satellite numbers to be stored.

FIGS. 10A and 10B are diagrams showing another example of a selection method for satellite numbers to be stored.

FIG. 11 is a diagram showing a list of satellite numbers.

DESCRIPTION OF EXEMPLARY EMBODIMENTS

Specific embodiments of the invention are explained in detail below with reference to the drawings and the like.

First Embodiment

Structure of an Electronic Timepiece

Figure 1:
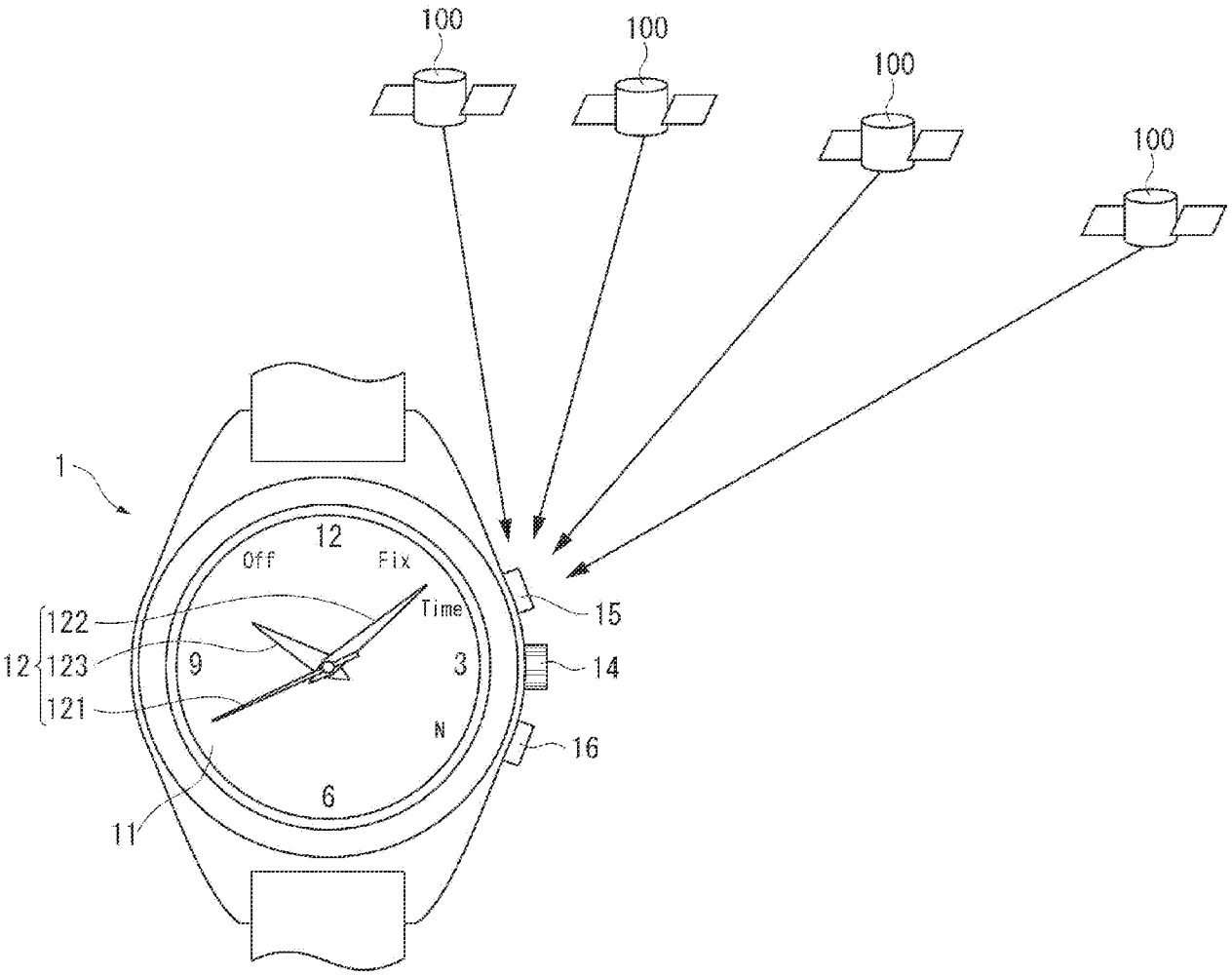
FIG. 1 is a plan view showing an electronic timepiece according to a first embodiment of the invention.

As shown in FIG. 1, an electronic timepiece 1 receives satellite signals from a plurality of GPS satellites 100 (the position information satellites in the invention) that orbit above the Earth on a predetermined track. When acquiring time information, the electronic timepiece 1 receives a satellite signal from at least one GPS satellite 100. When acquiring information for positioning calculation (e.g., track information of ephemeris or the like), the electronic timepiece 1 receives satellite signals from at least three (preferably four) GPS satellites 100. Note that the plurality of GPS satellites 100 are present above the Earth. About thirty GPS satellites 100 are orbiting currently.

The electronic timepiece 1 is a wristwatch worn on the wrist of a user. The electronic timepiece 1 includes a dial 11 and needles 12 and counts and displays time.

Most of the dial 11 is formed of a nonmetallic material (e.g., plastics or glass) that easily transmits light and a microwave in a 1.5 GHz band.

The needles 12 include a second hand 121, a minute hand 122, and an hour hand 123. The needles 12 are provided on the front surface side of the dial 11.

The electronic timepiece 1 includes a crown 14 and buttons 15 and 16 as input sections. The electronic timepiece 1 executes processing corresponding to manual operation of the crown 14 and the buttons 15 and 16. For example, when the crown 14 is operated, manual correction processing for correcting displayed time is executed according to the operation.

When the button 15 is pressed for a long time (e.g., 3 seconds or more), reception processing for receiving a satellite signal is executed (manual reception processing).

When the button 16 is pressed, processing for switching a reception mode (a time measuring mode and a positioning mode) is executed. When the reception mode is set in the positioning mode as a result of the switching processing for the reception mode corresponding to the operation of the button 16, the second hand 121 moves to the position of "Fix" (a 5-second position). When the reception mode is set in the time measuring mode, the second hand 121 moves to the position of "Time" (a 10-second position). Therefore, the user can easily check the set reception mode.

When the button 15 is pressed for a short time (e.g., 3 seconds or less), result display processing for displaying a result of the last reception processing is performed. That is, in the case of reception success in the positioning mode, the secondhand 121 moves to the position of "Fix" (the 5-second position). In the case of reception success in the time measuring mode, the second hand 121 moves to the position of "Time" (the 10-second position). In the case of reception failure, the second hand 121 moves to the position of "N" (a 20-second position).

The indication by the second hand 121 is also performed during reception. During reception in the positioning mode, the second hand 121 moves to the position of "Fix" (the 5-second position). During reception in the time measuring mode, the second hand 121 moves to the position of "Time" (the 10-second position). When the GPS satellites 100 cannot be captured, the second hand 121 moves to the position of "N" (the 20-second position).

The electronic timepiece 1 performs not only the manual reception processing by the button 15 but also automatic reception processing. As the automatic reception processing, there are regular automatic reception processing and photo-automatic reception processing.

That is, the electronic timepiece 1 performs the regular automatic reception processing when clocked internal time reaches set reception time.

The set reception time is time set in advance such as 2:00 am or 3:00 am or 7:00 am or 8:00 am. The reception time is set to 2:00 am or 3:00 am because the electronic timepiece 1 is removed from the user and placed on a desk or the like at the window in a stationary manner in an unworn state. Further, since few electric appliances are used and the influence of noise can be reduced, it is highly likely that a radio wave reception environment is satisfactory. The reception time is set to 7:00 am or 8:00 because the time is a commuting period of time and the user wearing the electronic timepiece 1 is present outdoors and can easily receive a satellite signal.

However, the reception time is not limited to these times. The user may set the automatic reception time.

When a generated voltage or a generated current of a solar panel explained below is equal to or larger than a setting value and it can be determined that the sunlight is irradiated on the solar panel outdoors, the electronic timepiece 1 performs the photo-automatic reception processing. Note that the number of times of the photo-automatic reception processing may be limited to once a day or the like.

Circuit Configuration of the Electronic Timepiece

Figure 2:
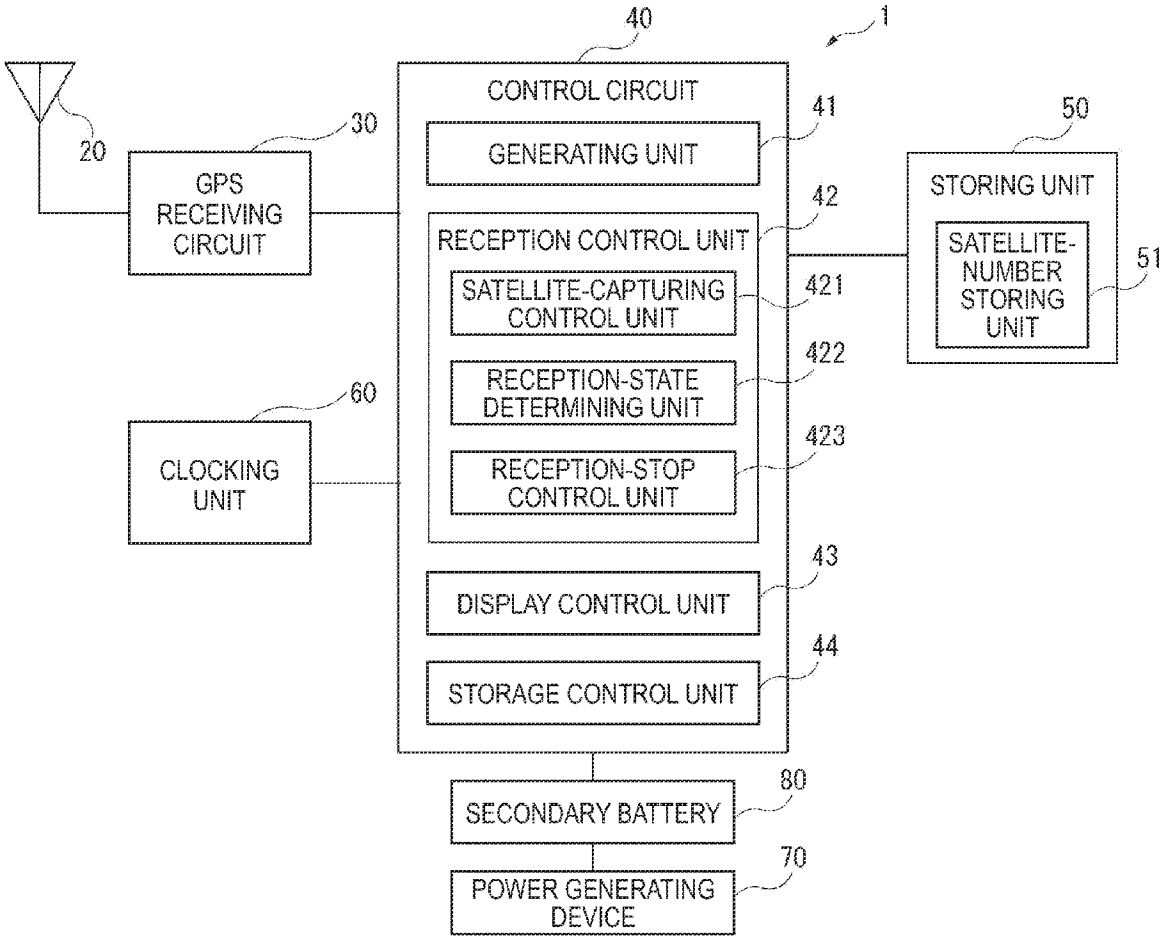
FIG. 2 is a block diagram showing a circuit configuration of the electronic timepiece.

FIG. 2 is a block diagram showing a circuit configuration of the electronic timepiece 1. As shown in the figure, the electronic timepiece 1 includes a GPS antenna 20, a GPS receiving circuit 30, a control circuit 40, a storing unit 50, a clocking unit 60, a power generation device 70, and a secondary battery 80.

The power generation device 70 includes a solar panel and a charging control circuit. Electric power generated by the power generation device 70 is charged in the secondary battery 80. The devices of the electronic timepiece 1 are driven by the electric power supplied from the secondary battery 80.

Receiving Unit

The GPS antenna 20 is an antenna that receives a microwave in a 1.5 GHz band and is arranged on the rear surface side of the dial 11. A portion of the dial 11 overlapping the GPS antenna 20 in a direction orthogonal to the dial 11 is formed of a material that easily transmits the microwave in the 1.5 GHz band (e.g., a nonmetallic material having low electric conductivity and magnetic permeability).

A solar panel including an electrode is not interposed between the GPS antenna 20 and the dial 11. Therefore, the GPS antenna 20 can receive a satellite signal transmitted through the dial 11.

Although not shown in the figure, the GPS receiving circuit 30 mainly includes an RF (Radio Frequency) unit and a GPS-signal processing unit. The RF unit and the GPS-signal processing unit perform processing for acquiring track information and satellite information such as GPS time included in a navigation message from a satellite signal in the 1.5 GHz band.

The RF unit is a general RF unit in a GPS receiver including, for example, a down converter that converts a high-frequency signal into a signal in an intermediate frequency band and an A/D converter that converts an analog signal in the intermediate frequency band into a digital signal.

Although not shown in the figure, the GPS signal processing unit includes a DSP (Digital Signal Processor), a CPU (Central Processing Unit), an SRAM (Static Random Access Memory), and an RTC (real time clock). The GPS signal processing unit performs processing for demodulating a navigation message from a digital signal (a signal in an intermediate frequency band) output from the RF unit and acquiring satellite information such as track information and GPS time included in the navigation message.

Therefore, in this embodiment, the receiving unit that receives satellite signals transmitted from the GPS satellites 100 is configured by the GPS antenna 20 and the GPS receiving circuit 30.

Note that the GPS receiving circuit 30 in this embodiment includes a 12-channel receiving circuit such that twelve satellite signals can be simultaneously captured and received.

Control Circuit

The control circuit 40 is configured by a CPU for controlling an electronic timepiece 1. The control circuit 40 includes a generating unit 41, a reception control unit 42, a display control unit 43, and a storage control unit 44.

The generating unit 41 acquires time information and information for positioning calculation from satellite signals received by the GPS antenna 20 and the GPS receiving circuit 30, generates generation information such as time information and position information of the present location from these kinds of acquired information, and stores the generation information in the storing unit 50.

Further, the generating unit 41 counts a reference signal generated by a quartz oscillator and an oscillation circuit not shown in the figure and updates internal time data stored in the storing unit 50. The internal time data is local time obtained by correcting received time information using UTC offset and further correcting the time information using time difference information. Therefore, when the generating unit 41 receives satellite signals, the generating unit 41 corrects received time information using the UTC offset and the time difference information and updates the internal time data. When the generating unit 41 does not receive satellite signals, the generating unit 41 updates the internal time data with the reference signal.

The reception control unit 42 controls the GPS receiving circuit 30 and performs reception processing for the satellite signals during the manual reception processing and during the automatic reception processing explained above.

For the reception processing, the reception control unit 42 includes a satellite-capturing control unit 421, a reception-state determining unit 422, and a reception-stop control unit 423.

The satellite-capturing control unit 421 controls the GPS receiving circuit 30, sets a threshold of a reception signal level, searches for the GPS satellites 100, and captures the GPS satellites 100. In this embodiment, the threshold is set to a maximum threshold, an intermediate threshold, and a minimum threshold. The minimum threshold is the predetermined value according to the invention. The satellite-capturing control unit 421 searches for, as preferential search satellites, the GPS satellites 100 having satellite numbers stored in a satellite-number storing unit 51 of the storing unit 50 explained below more preferentially than the other GPS satellites 100.

At timing of an end of the search for the preferential search satellites for which the threshold of the reception signal level by the satellite-capturing control unit 421 is set to the minimum threshold, the reception-state determining unit 422 determines whether the number of the GPS satellite 100 captured by the satellite-capturing control unit 421 is equal to or larger than a predetermined number. The predetermined number is, for example, three.

The reception-stop control unit 423 controls the GPS receiving circuit 30 to stop the reception of the satellite signals. As an example of the stop of the reception, when the reception-state determining unit 422 determines that the number of the GPS satellites 100 is smaller than the predetermined number, the reception-stop control unit 423 controls the GPS receiving circuit 30 to stop the reception of the satellite signals.

Therefore, in the case of a search for which the threshold of the reception signal level is set to the maximum threshold or the intermediate threshold, after searching for the preferential search satellites, the satellite-capturing control unit 421 searches for the other GPS satellites 100. On the other hand, in the case of a search for which the threshold is set to the minimum threshold, at timing when the search for the preferential search satellite ends, when the reception-state determining unit 422 determines that the number of the captured GPS satellites 100 is equal to or larger than the predetermined number, the satellite-capturing control unit 421 searches for the other GPS satellites 100. When the reception-state determining unit 422 determines that the number of the captured GPS satellites 100 is smaller than the predetermined number, since the reception processing is stopped by the reception-stop control unit 423, the satellite-capturing control unit 421 does not perform a search for the other GPS satellites 100.

The display control unit 43 controls driving of the clocking unit 60 to display the present time. The clocking unit 60 includes the needles 12 and a motor that drives the needles 12.

When the information for positioning calculation is acquired, the display control unit 43 indicates, with the second hand 121 and the like, a time zone corresponding to position information of the present location, which is a positioning result generated from the information for positioning calculation. That is, in the outer circumference of the dial 11, an abbreviation of a city name indicating the time zone not shown in the figure is displayed. When the information for positioning calculation is acquired and the position information of the present location is generated, the display control unit 43 indicates, with the second hand 121, the city name in the time zone including the position information for a fixed time.

Therefore, a display unit that displays generation information generated by the generating unit 41 such as time information is configured by the clocking unit 60 and the display control unit 43.

Usually, the display control unit 43 drives the needles 12 in association with the update of the internal time data with the reference signal. When the satellite signals are received and the internal time data is corrected on the basis of the received time information, the display control unit 43 drives the needles 12 in association with the correction to display correct time.

The storage control unit 44 stores, in the satellite-number storing unit 51 included in the storing unit 50, satellite numbers (PRNs) of the GPS satellites 100 captured by the satellite-capturing control unit 421.

In this case, the storage control unit 44 stores, in the satellite-number storing unit 51, satellite numbers of the GPS satellites 100, signal reception levels (SNRs: Signal to Noise Ratios) of which are equal to or higher than a predetermined level (e.g., equal to or higher than "SNR35"), among the captured GPS satellite 100. Note that the reception signal level can also be represented by "dBm", which is a unit indicating signal intensity. For example, "SNR35" is equivalent to about "−137.5 dBm".

Storing Unit

In the storing unit 50, the acquired information acquired by the GPS receiving circuit 30 and the generation information generated by the generating unit 41 are stored. For example, in the storing unit 50, time information (satellite time information), information for positioning calculation (track information, etc.), position information of a positioning result, UTC offset, time difference information, and internal time data are stored.

The UTC offset is obtained by acquiring and storing information concerning "present leap second" included in sub-frame 14, page 18 of a satellite signal of a GPS.

The time difference information is time difference data for correcting UTC to local time. The time difference data may be set by the user operating the crown 14 and the buttons 15 to 16 or may be set on the basis of time information generated from information for positioning calculation acquired during reception (during positioning processing) in the positioning mode. When the time difference data is obtained on the basis of the generated position information, a correspondence table of the position information (a positioning result) and the time difference data (a time zone) only has to be stored in the storing unit 50.

The storing unit 50 includes the satellite-number storing unit 51 controlled by the storage control unit 44. In the satellite-number storing unit 51, satellite numbers of the GPS satellites 100 captured by the GPS receiving circuit 30 during the automatic reception processing are stored.

Navigation Message

A navigation message, which is a satellite signal, transmitted from the GPS satellite 100 including the respective kinds of acquired information is explained. Note that the navigation message is modulated to a radio wave of a satellite as 50 bps data.

Figure 3A:
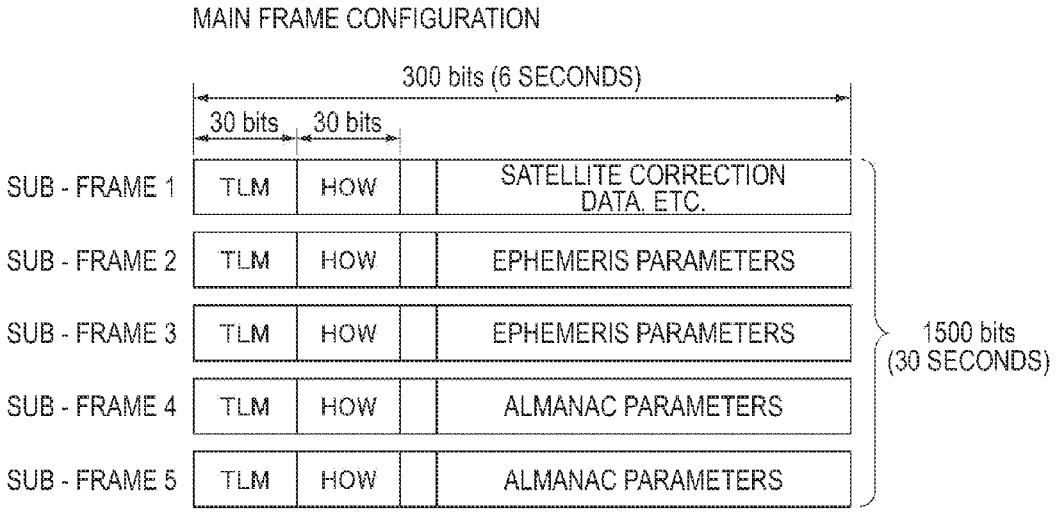
FIGS. 3A to 3C are diagrams for explaining the configuration of a navigation message.
Figure 3B:
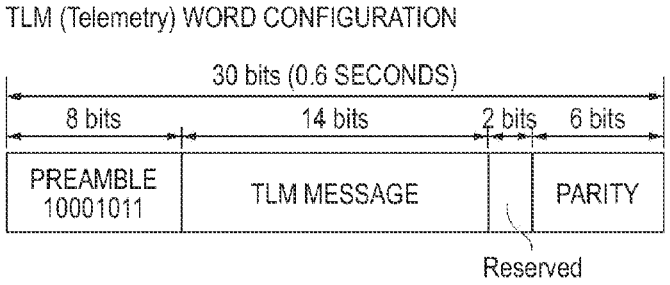
Figure 3C:
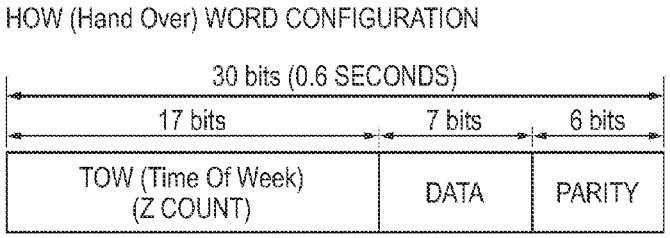

FIGS. 3A to 3C are diagrams for explaining the configuration of the navigation message.

As shown in FIG. 3A, the navigation message is configured as data including a main frame of 1500 bits in total as one unit. The main frame is divided into five sub-frames 1 to 5 of 300 bits each. Data of one sub-frame is transmitted from the GPS satellites 100 in 6 seconds. Therefore, the data of one main frame is transmitted from the GPS satellites 100 in 30 seconds.

The sub-frame 1 includes week number data (WN: week number) and satellite correction data.

The week number data is information representing a week including the present GPS time information and is updated in units of one week.

The sub-frames 2 and 3 include ephemeris parameters (detailed track information of the GPS satellites 100). The sub-frames 4 and 5 include almanac parameters (substantial track information of all the GPS satellites 100).

Further, the sub-frames 1 to 5 include TLM (Telemetry) words in which 30-bit TLM (Telemetry word) data is stored and HOW words in which 30-bit HOW (hand over word) data is stored.

Therefore, the TLM words and the HOW words are transmitted from the GPS satellites 100 at an interval of 6 seconds. On the other hand, the week number data, the satellite correction data, the ephemeris parameters, and the almanac parameters are transmitted at an interval of 30 seconds.

As shown in FIG. 3B, the TLM word includes preamble data, a TLM message, Reserved bits, and parity data.

As shown in FIG. 3C, the HOW word includes GPS time information called TOW (Time of Week, also referred to as "Z count"). As Z count data, an elapsed time from 0 o'clock of Sunday every week is displayed in seconds. The Z count data is reset to 0 at 0 o'clock of Sunday next week. That is, the Z count data is information in second units indicated for each week from the beginning of the week. The Z count data indicates GPS time information when the top bit of the next sub-frame data is transmitted.

Therefore, the electronic timepiece 1 can acquire date information and time information by acquiring the week number data included in the sub-frame 1 and the HOW word (the Z count data) included in the sub-frames 1 to 5. However, when the electronic timepiece 1 acquired the week number data before and counted, on the inside, an elapsed time from a period when the week number data was acquired, the electronic timepiece 1 can obtain the present week number data of the GPS satellites 100 without acquiring the week number data.

Therefore, the electronic timepiece 1 only has to acquire the week number data of the sub-frame 1 only when the week number data (the date information) is not stored on the inside, for example, after reset or during power-on. When the week number data is stored, the electronic timepiece 1 can learn the present time if the electronic timepiece 1 acquires the TOW transmitted at every 6 seconds. Therefore, usually, the electronic timepiece 1 acquires only the TOW as time information.

As the leap second information, as explained above, the information concerning "present leap second" included in the sub-frame 4, page 18 is acquired and stored. In the sub-frame 4, page 18, information concerning "an update week and an update date of leap second and leap second after update" is also included. When update of the leap second is performed, timing of the update is notified beforehand. When the leap second is updated, usually, the update is executed on the last day of December or June. Therefore, if the electronic timepiece 1 performs acquisition processing for leap second information to receive the sub-frame 14, page 18 a fixed period before the end of December and the end of June, the electronic timepiece 1 can acquire presence or absence of update of the leap second and a correction value of the leap second in the case of presence of the update.

Reception Processing

Reception processing of the electronic timepiece 1 is explained with reference to flowcharts of FIGS. 4 and 5 as well.

Figure 4:
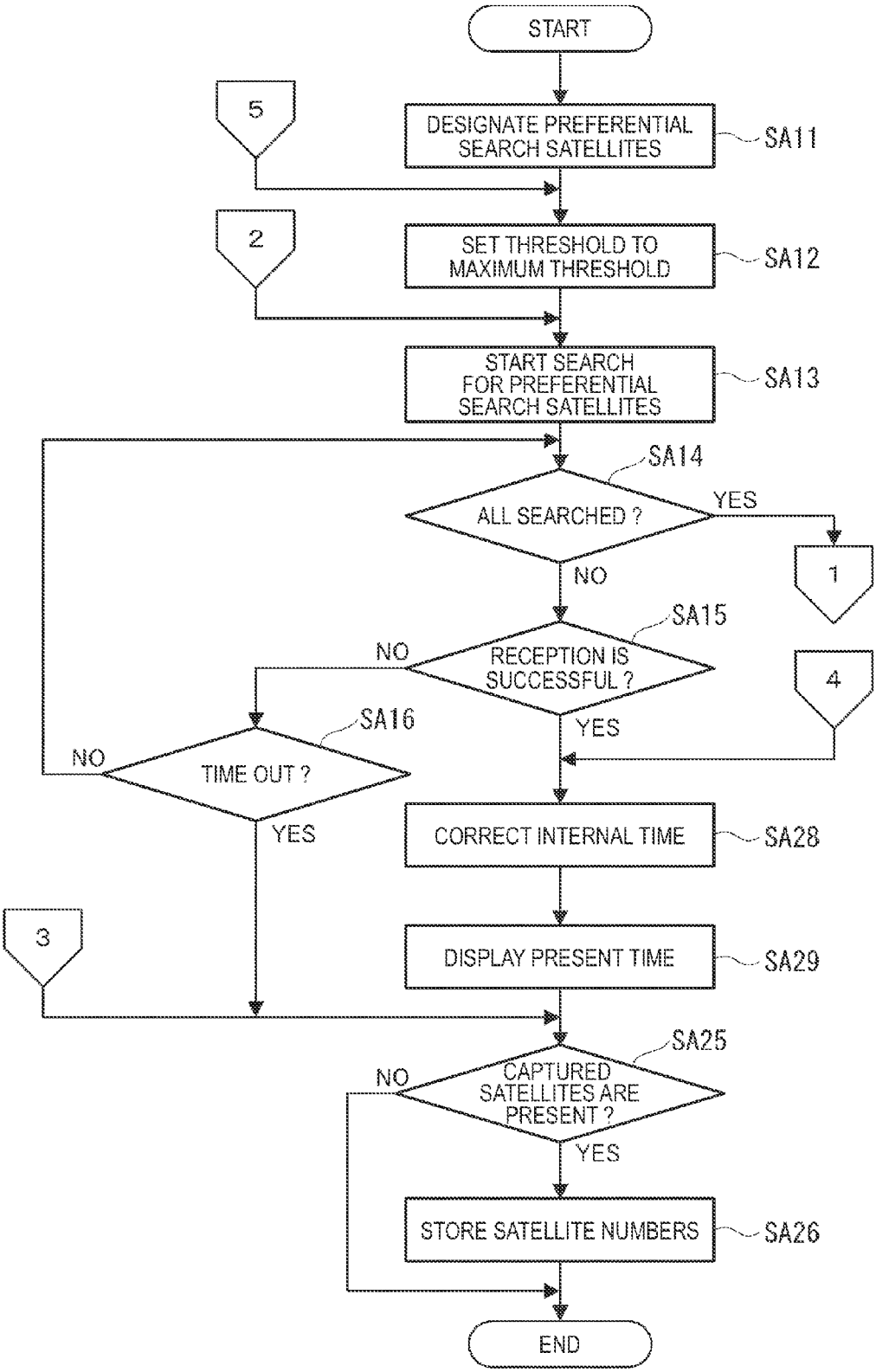
FIG. 4 is a flowchart for explaining reception processing in the first embodiment.
Figure 5:
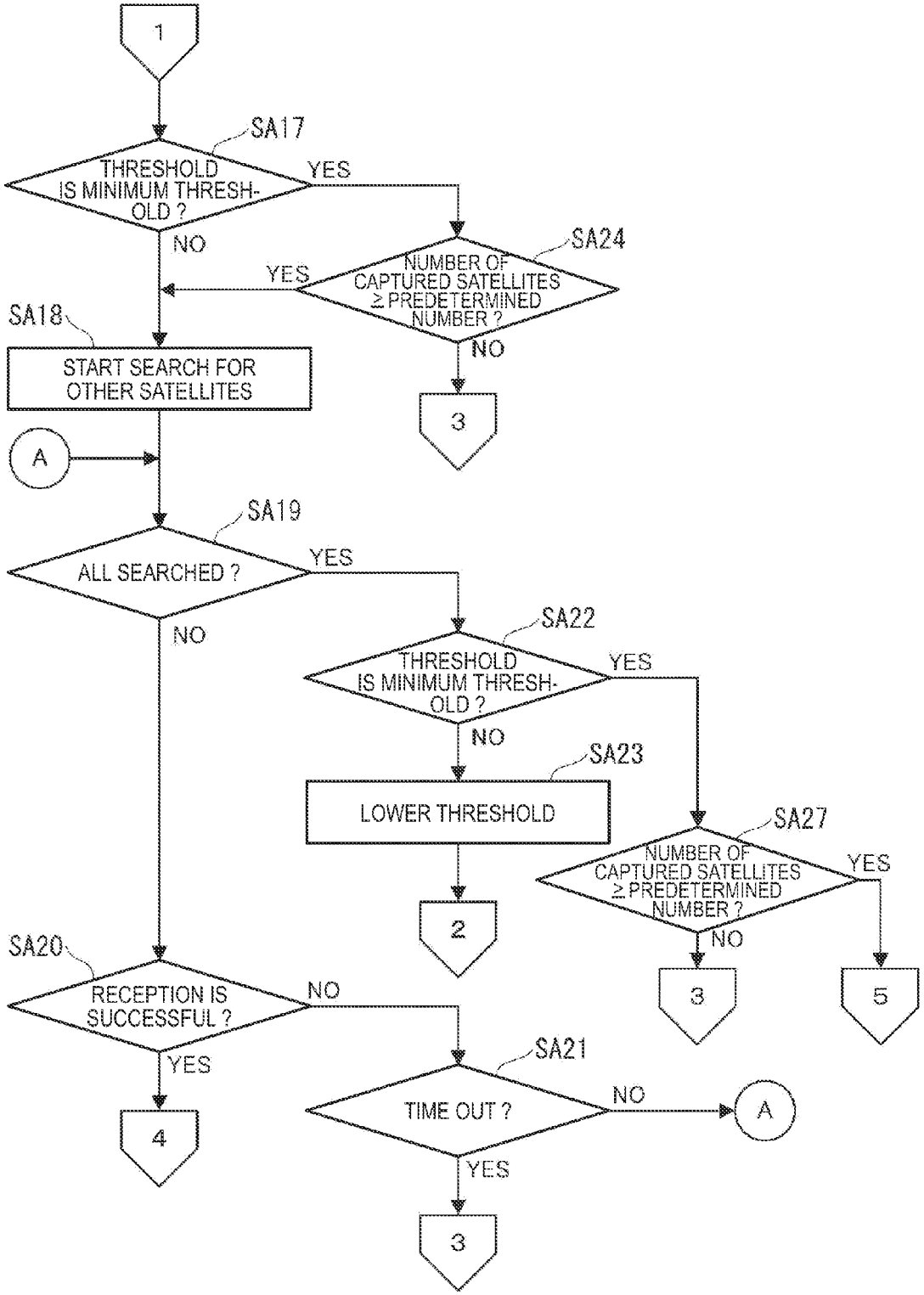
FIG. 5 is a flowchart for explaining the reception processing in the first embodiment.

The reception processing shown in FIGS. 4 and 5 is processing performed when the satellite numbers are stored in the satellite-number storing unit 51. The reception processing is executed by the reception control unit 42 during the automatic reception processing and during the manual reception processing.

When the reception processing is executed, the satellite-capturing control unit 421 accesses the satellite-number storing unit 51. The satellite-capturing control unit 421 designates, as preferential search satellites, the GPS satellites 100 having all the satellite numbers stored in the satellite-number storing unit 51 (SA11). In the satellite-number storing unit 51, the satellite numbers of the GPS satellites 100 captured during the last reception processing are stored.

The satellite-capturing control unit 421 starts reception of satellite signals transmitted from the GPS satellites 100. Specifically, the satellite-capturing control unit 421 controls the GPS receiving circuit 30 to generate patterns of C/A codes of the GPS satellites 100 and starts reception. The satellite-capturing control unit 421 calculates correlation values of the C/A codes and the received satellite signals and captures the GPS satellites 100 that can synchronize with one another.

First, the satellite-capturing control unit 421 sets the threshold of the reception signal level to the maximum threshold (e.g., −125 dBm), which is the first threshold according to the invention (SA12).

Note that the threshold of the reception signal level is a threshold for determining the captured GPS satellites 100. That is, when a reception state is determined, the GPS satellites 100, reception signal levels of which exceed the threshold, are determined as captured satellites.

The satellite-capturing control unit 421 starts a search for the preferential search satellites (SA13).

Subsequently, the satellite-capturing control unit 421 determines whether all the preferential search satellites are searched (SA14). It is determined No in SA14 until all the preferential search satellites are searched.

When it is determined No in SA14, the generating unit 41 receives time information from satellite signals of the captured GPS satellites 100. The generating unit 41 determines whether reception of time information is successful (SA15).

When it is determined No in SA15, the reception control unit 42 determines whether time from the start of the reception processing exceeds a time-out time (SA16). The time-out time is set to, for example, 60 seconds.

When it is determined No in SA16, the reception control unit 42 returns the processing to SA14.

That is, except when the acquisition of the time information is successful, the processing in SA14 to SA16 is repeated within the time-out time until all the preferential search satellites are searched.

When the search for all the preferential search satellite is ended in a state in which the reception of the time information is unsuccessful, it is determined Yes in SA14. The satellite-capturing control unit 421 determines whether the set threshold is the minimum threshold (the predetermined value) (SA17). At first, since the threshold is set to the maximum threshold, it is determined No in SA17.

When it is determined No in SA17, the satellite-capturing control unit 421 starts a search for the other GPS satellites 100 that are not searched as the preferential search satellites (SA18). The search is performed in the order of the satellite numbers.

Subsequently, the satellite-capturing control unit 421 determines whether all the other GPS satellites 100 are searched (SA19). It is determined No in SA19 until all the other GPS satellites 100 are searched.

When it is determined No in SA19, the generating unit 41 receives time information from satellite signals of the captured GPS satellites 100. The generating unit 41 determines whether the reception of the time information is successful (SA20).

When it is determined No in SA20, the reception control unit 42 determines whether time from the start of the reception processing exceeds the time-out time (SA21). The time-out time is set to, for example, 60 seconds.

When it is determined No in SA21, the reception control unit 42 returns the processing to SA19.

That is, except when the acquisition of the time information is successful, the processing in SA19 to SA21 is repeated within the time-out time until all the other GPS satellites 100 are searched.

Note that the search for the other GPS satellites 100 ends, for example, at a point when an elapsed time from the start of the reception processing is one second.

When the search for the other GPS satellites 100 is ended in a state in which the reception of the time information is unsuccessful, it is determined Yes in SA19. The satellite-capturing control unit 421 determines whether the set threshold is the minimum threshold (SA22). At first, since the threshold is set to the maximum threshold, it is determined No in SA22.

When it is determined No in SA22, the satellite-capturing control unit 421 lowers the threshold of the reception signal level and sets the threshold to the intermediate threshold (e.g., −130 dBm) (SA23). The satellite-capturing control unit 421 returns the processing to SA13 and starts a search for the preferential search satellites.

Except when the acquisition of the time information is successful, the processing in SA14 to SA16 is repeated within the time-out time until all the preferential search satellites are searched.

When all the preferential search satellites are searched in a state in which the reception of the time information is unsuccessful, it is determined Yes in SA14. In SA17, the satellite-capturing control unit 421 determines whether the threshold is the minimum threshold. Since the threshold is set to the intermediate threshold, it is determined No in SA17.

In SA18, the satellite-capturing control unit 421 starts a search for the other GPS satellites 100.

Except when the acquisition of the time information is successful, the processing in SA19 to SA21 is repeated within the time-out time until all the other GPS satellites 100 are searched.

Note that the search for the other GPS satellites 100 ends, for example, at a point when an elapsed time from the start of the reception processing is 10 seconds.

When the search for the other GPS satellites 100 is ended in a state in which the reception of the time information is unsuccessful, it is determined Yes in SA19. In SA22, the satellite-capturing control unit 421 determines whether the set threshold is the minimum threshold. Since the threshold is set to the intermediate threshold, it is determined No in SA22.

In SA23, the satellite-capturing control unit 421 lowers the threshold of the reception signal level and sets the threshold to the minimum threshold (e.g., −140 dBm), which is the second threshold according to the invention. The satellite-capturing control unit 421 returns the processing to SA13 and starts a search for the preferential search satellites.

Except when the acquisition of the time information is successful, the processing of SA14 to SA16 is repeated within the time-out time until all the preferential search satellites are searched.

When all the preferential search satellites are searched in a state in which the reception of the time information is unsuccessful, it is determined Yes in SA14. In SA17, the satellite-capturing control unit 421 determines whether the set threshold is the minimum threshold. Since the threshold is set to the minimum threshold, it is determined Yes in SA17.

When it is determined Yes in SA17, the reception-state determining unit 422 determines whether the number of the (currently captured) GPS satellites 100 (the number of captured satellites) captured by the satellite-capturing control unit 421 is equal to or larger than a predetermined number (SA24). The predetermined number is, for example, three.

When it is determined No in SA24, the reception-state determining unit 422 advances the processing to SA25. In this case, the search for the other GPS satellites 100 by the satellite-capturing control unit 421 is not performed. After determination processing in SA25 and storage processing in SA26 explained below are executed, the reception-stop control unit 423 controls the GPS receiving circuit 30 and ends the reception processing for the satellite signals.

When it is determined Yes in SA24, the reception-state determining unit 422 advances the processing to SA18.

Except when the acquisition of the time information is successful, the processing in SA19 to SA21 is repeated within the time-out time until all the other GPS satellites 100 are searched.

Note that the search for the other GPS satellites 100 ends, for example, at a point when an elapsed time from the start of the reception processing is 60 seconds.

When all the other GPS satellites 100 are searched in a state in which the reception of the time information is unsuccessful, it is determined Yes in SA19. In SA22, the satellite-capturing control unit 421 determines whether the set threshold is the minimum threshold. Since the threshold is set to the minimum threshold, it is determined Yes in SA22.

When it is determined Yes in SA22, the reception-state determining unit 422 determines whether the number of the (currently captured) GPS satellites 100 (the number of captured satellites) captured by the satellite-capturing control unit 421 is equal to or larger than a predetermined number (SA27). The predetermined number is, for example, three.

When it is determined Yes in SA27, the satellite-capturing control unit 421 returns the processing to SA12. The search for the position information satellites with the threshold set to the maximum threshold is executed again.

On the other hand, when it is determined No in SA27, the reception-state determining unit 422 advances the processing to SA25. In this case, after the determination processing in SA25 and the storage processing in SA26 explained below are executed, the reception-stop control unit 423 controls the GPS receiving circuit 30 and ends the reception processing for the satellite signals.

On the other hand, when it is determined in SA15 and SA20 that the acquisition of the time information is successful, the generating unit 41 corrects the internal time (SA28). Specifically, the generating unit 41 corrects the internal time data on the basis of the received time information.

The display control unit 43 performs present time display (SA29). Specifically, the display control unit 43 drives the clocking unit 60 and displays time of the corrected internal time data.

When the processing in SA29 is performed, when it is determined No in SA24, when it is determined No in SA27, and when it is determined in SA16 and SA21 that the time exceeds the time-out time, the storage control unit 44 determines whether the GPS satellites 100 captured by the satellite-capturing control unit 421 are present (SA25).

When it is determined Yes in SA25, the storage control unit 44 overwrites and stores, in the satellite-number storing unit 51, the satellite numbers of the GPS satellites 100, reception signal levels of which are equal to or higher than a predetermined level, among the GPS satellites 100 captured by the satellite-capturing control unit 421 (SA26). The predetermined level is, for example, "SNR35".

For example, it is assumed that nine GPS satellites 100 are captured by the satellite-capturing control unit 421 and the satellite numbers (PRNs) and the reception signal levels (SNRs) of the GPS satellites 100 are in a relation shown in FIG. 6A. In this case, six satellite numbers with the reception signal levels equal to or higher than "SNR35" shown in FIG. 6B are stored in the satellite-number storing unit 51.

When the processing in SA26 is performed and when it is determined No in SA25, the reception-stop control unit 423 controls the GPS receiving circuit 30 and ends the reception processing.

The processing performed when the satellite numbers are stored in the satellite-number storing unit 51 is explained above. When the satellite numbers are not stored in the satellite-number storing unit 51, the search for the position information satellites is performed in the order of the satellite numbers. Note that, in this case, as explained above, the storage processing for the satellite numbers by the storage control unit 44 is performed.

Action and Effects of the First Embodiment

According to this embodiment, action and effects explained below are obtained.

According to this embodiment, during the reception processing, the satellite-capturing control unit 421 accesses the satellite-number storing unit 51 and searches for the GPS satellites 100 (the preferential search satellites) having the satellite numbers stored in the satellite-number storing unit 51 more preferentially than the other GPS satellites 100. That is, according to this embodiment, during the reception processing, the GPS satellites 100 captured during the last reception processing are searched more preferentially than the other GPS satellites 100. Therefore, it is possible to capture the GPS satellites 100 early compared with when the GPS satellites 100 are searched in the order of the satellite numbers.

Since the GPS satellites 100 can be captured early in this way, it is possible to succeed in the reception of the time information early and reduce power consumption.

According to this embodiment, in SA24, when it is determined that the number of the captured GPS satellites 100 is smaller than the predetermined number, the reception-stop control unit 423 stops the reception of the satellite signals.

Consequently, according to this embodiment, effects explained below can be obtained by setting the predetermined number to the number of the GPS satellites 100 (e.g., three) set as a reference with which the reception of the time information can be expected. That is, in a time-consuming search in which the threshold of the reception signal level is set to the minimum threshold, at timing when the search for the preferential search satellites ends, when the GPS satellites 100 are not captured by the number with which reception of the time information can be expected, a time-consuming search for the other GPS satellites 100 is not performed and the reception processing is stopped. Therefore, it is possible to reduce power consumption.

According to this embodiment, in SA27, when it is determined that the number of the captured GPS satellites 100 is smaller than the predetermined number, the reception-stop control unit 423 stops the reception of the satellite signals. Consequently, at timing when the search for the preferential search satellites and the other GPS satellites 100, in which the threshold of the reception signal level is set to the minimum threshold, ends, when the GPS satellites 100 are not captured by the number with which reception of the time information can be expected, a search with the threshold reset to the maximum threshold is not performed and the reception processing is stopped. Therefore, it is possible to reduce power consumption.

According to this embodiment, in the satellite-number storing unit 51, the satellite numbers of the GPS satellites 100 captured during the last automatic reception processing only have to be stored. Therefore, it is possible to reduce an information amount to be stored and the size of a memory circuit compared with, for example, when a reception history at every time is stored.

The GPS satellites 100 only have to be searched according to the satellite numbers stored in the satellite-number storing unit 51. Therefore, it is possible to simplify the reception processing compared with, for example, when the reception history at every time is searched through to select an optimum satellite number and search for the GPS satellite 100.

Consequently, it is possible to further reduce power consumption.

In this embodiment, after setting the threshold of the reception signal level to the maximum threshold and searching for the GPS satellites 100, the satellite-capturing control unit 421 sequentially sets the threshold to the intermediate threshold and the minimum threshold and searches for the GPS satellites 100.

Accordingly, if the GPS satellites 100 having high reception signal levels are present, it is highly likely that the GPS satellites 100 can be captured in a search at a pre-stage when the threshold is set to the maximum threshold or the intermediate threshold.

When the threshold is higher, a search time for the GPS satellites 100 can be reduced. Therefore, according to this embodiment, it is possible to capture the GPS satellites 100 having high reception signal levels early compared with, for example, when the search is performed with the threshold fixed to the minimum threshold.

From the captured GPS satellites 100, the time information can be sequentially received before the search for all the GPS satellites 100 ends. The GPS satellites 100 having high reception signal levels have high reception success rates of the time information. Therefore, since the GPS satellites 100 having high reception signal levels can be captured early, it is possible to succeed in the reception of the time information earlier.

On the other hand, the GPS satellites 100 having low reception signal levels can be captured in a search with the threshold set to the minimum threshold.

In this embodiment, the storage control unit 44 stores, in the satellite-number storing unit 51, the satellite numbers of the GPS satellites 100, reception signal levels of which are equal to or higher than the predetermined level, among the GPS satellites 100 captured during the automatic reception processing.

Accordingly, the satellite-capturing control unit 421 searches for the GPS satellites 100, reception signal levels of which are equal to or higher than the predetermined level. Therefore, it is possible to efficiently capture the GPS satellites 100 having reception success rates of the time information by setting the predetermined level to a reference with which it can be determined that a reception success rate of the time information is high.

Consequently, it is possible to succeed in the reception of the time information earlier and further reduce power consumption.

In this embodiment, at timing when the reception of the satellite signals ends, the storage control unit 44 stores the satellite numbers of the captured GPS satellites 100 in the satellite-number storing unit 51 (SA26).

The GPS satellites 100 that cannot be captured before the reception processing of the satellite signals ends after being once captured are predicted to be located, for example, at the outer edge of a receivable range and are considered to have low reception success rates of the time information. According to the configuration explained above, the GPS satellites 100 can be excluded from search targets. Therefore, it is possible to efficiently capture the GPS satellites 100 having high reception success rates of the time information.

Second Embodiment

A second embodiment of the invention is explained with reference to the drawings.

The second embodiment is different from the first embodiment in that, in reception processing, storage of satellite numbers by the storage control unit 44 is performed for the GPS satellites 100 captured in a fixed time. The other configuration is the same as the configuration of the first embodiment.

Figure 7:
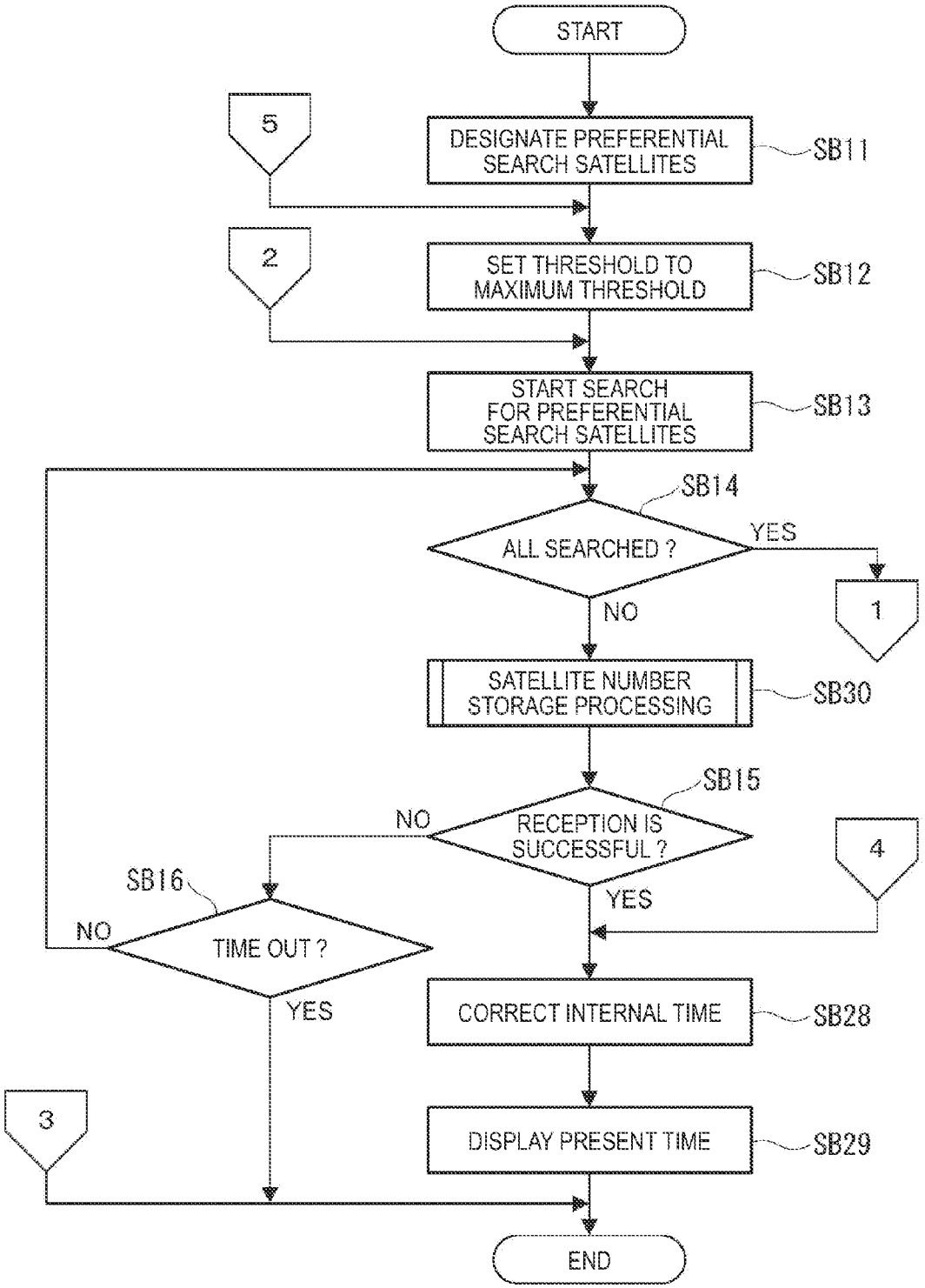
FIG. 7 is a flowchart for explaining reception processing in a second embodiment.
Figure 8:
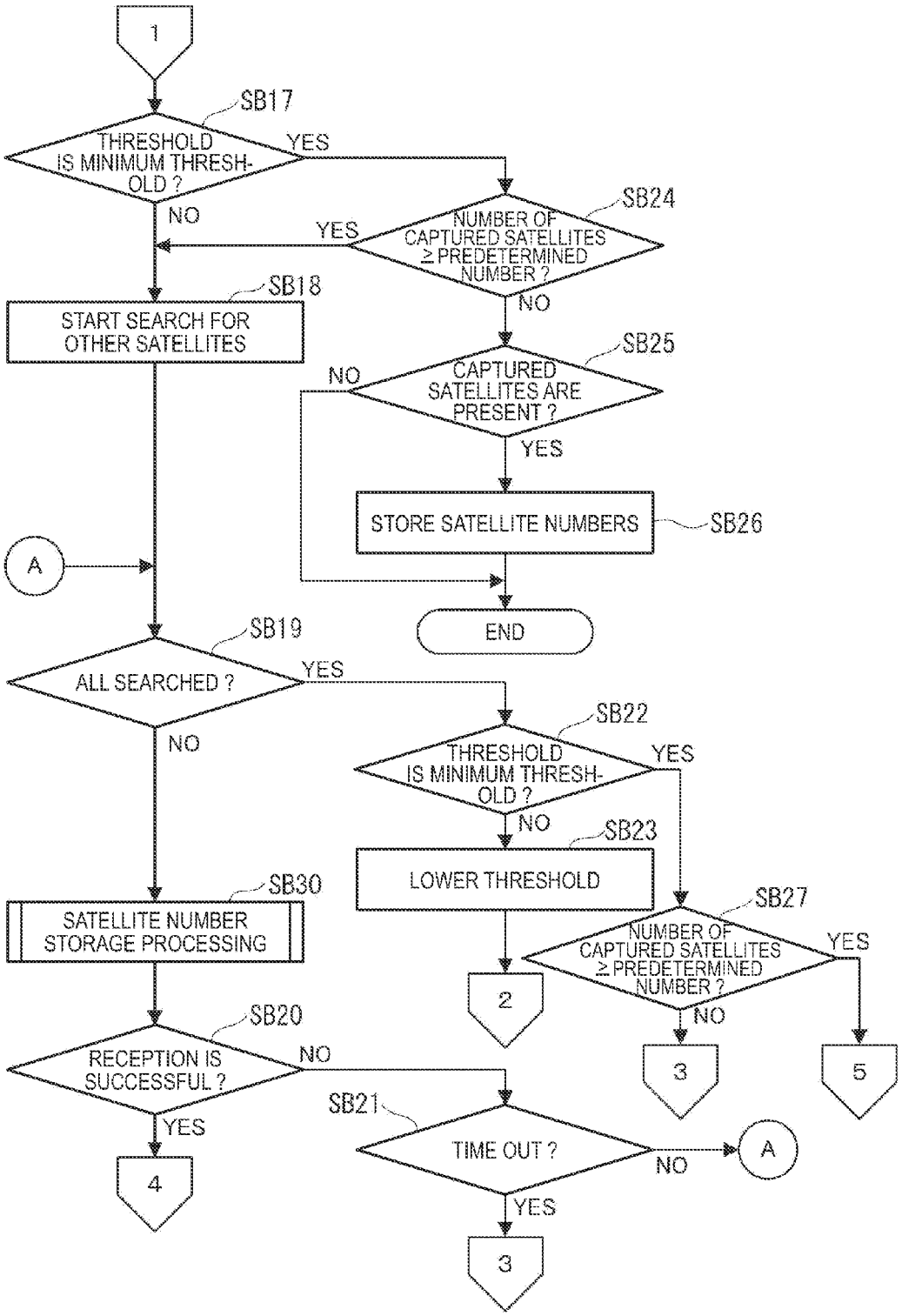
FIG. 8 is a flowchart for explaining the reception processing in the second embodiment.

FIGS. 7 and 8 are flowcharts for explaining reception processing in the second embodiment.

As shown in FIGS. 7 and 8, the control circuit 40 performs processing in SB11 to SB30. Processing in SB11 to SB29 is the same as the processing in SA11 to SA29 in the first embodiment. Therefore, explanation of the processing is omitted.

In the first embodiment, the storage control unit 44 stores the satellite numbers in the satellite-number storing unit 51 immediately before the reception processing ends (SA26).

On the other hand, in the second embodiment, after it is determined No in SB14, the storage control unit 44 executes satellite number storage processing (SB30) explained below and stores the satellite numbers in the satellite-number storing unit 51. After SB30 is executed, the storage control unit 44 advances the processing to SB15.

That is, in a search period for the preferential search satellites and while the reception of the time information is unsuccessful (while it is determined No in SB15), the processing of SB30 is repeatedly executed within the time-out time.

Figure 9:
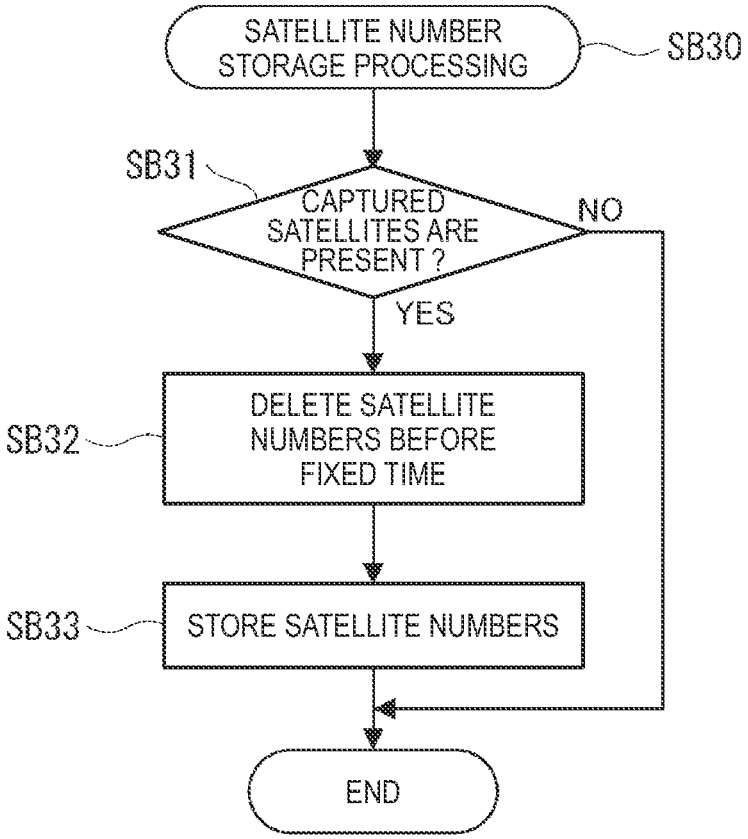
FIG. 9 is a flowchart for explaining satellite number storing processing in the second embodiment.

FIG. 9 is a flowchart for explaining satellite number storage processing.

The storage control unit 44 determines whether the GPS satellites 100 captured by the satellite-capturing control unit 421 are present (SB31). When it is determined No in SB31, the storage control unit 44 ends the processing.

When it is determined Yes in SB31, the storage control unit 44 deletes the satellite numbers, which are stored a fixed time (e.g., 10 seconds) before the present, among the satellite numbers stored in the satellite-number storing unit (SB32).

The storage control unit 44 overwrites and stores, in the satellite-number storing unit 51, the satellite numbers of the GPS satellites 100, reception signal levels of which are equal to or higher than a predetermined level, among the GPS satellites 100 captured by the satellite-capturing control unit 421 (SB33) and ends the processing.

The satellite number storage processing (SB30) is repeatedly executed in the search period for the preferential search satellites. Consequently, in the satellite-number storing unit 51, the satellite numbers of the GPS satellites 100 captured by the satellite-capturing control unit 421 in the fixed time are stored.

In the second embodiment, even after it is determined No in SB19, the storage control unit 44 executes the satellite number storage processing (SB30) and stores the satellite numbers in the satellite-number storing unit 51. After SB30 is executed, the storage control unit 44 advances the processing to SB20.

That is, in a search period for the other GPS satellites 100 and while the reception of the time information is unsuccessful (while it is determined No in SB20), the processing in SB30 is repeatedly executed within the time-out time.

In this way, the satellite number storage processing (SB30) is repeatedly executed in the search period for the other GPS satellite 100. Therefore, in the satellite-number storing unit 51, the satellite numbers of the GPS satellites 100 captured by the satellite-capturing control unit 421 in the fixed time are stored.

Action and Effects of the Second Embodiment

According to this embodiment, since the number of the satellite numbers stored in the satellite-number storing unit 51 increases, the number of the preferential search satellites searched by the satellite-capturing control unit 421 also increases.

Consequently, the number of the preferential search satellites captured by the satellite-capturing control unit 421 also increase. It is possible to improve the reception success rate of the time information.

Third Embodiment

A third embodiment of the invention is explained with reference to the drawings.

An electronic timepiece of the third embodiment is different from the electronic timepiece 1 of the first embodiment in that, in reception processing, the number of GPS satellites 100 captured by the satellite-capturing control unit 421 is also determined at predetermined time intervals.

Figure 12:
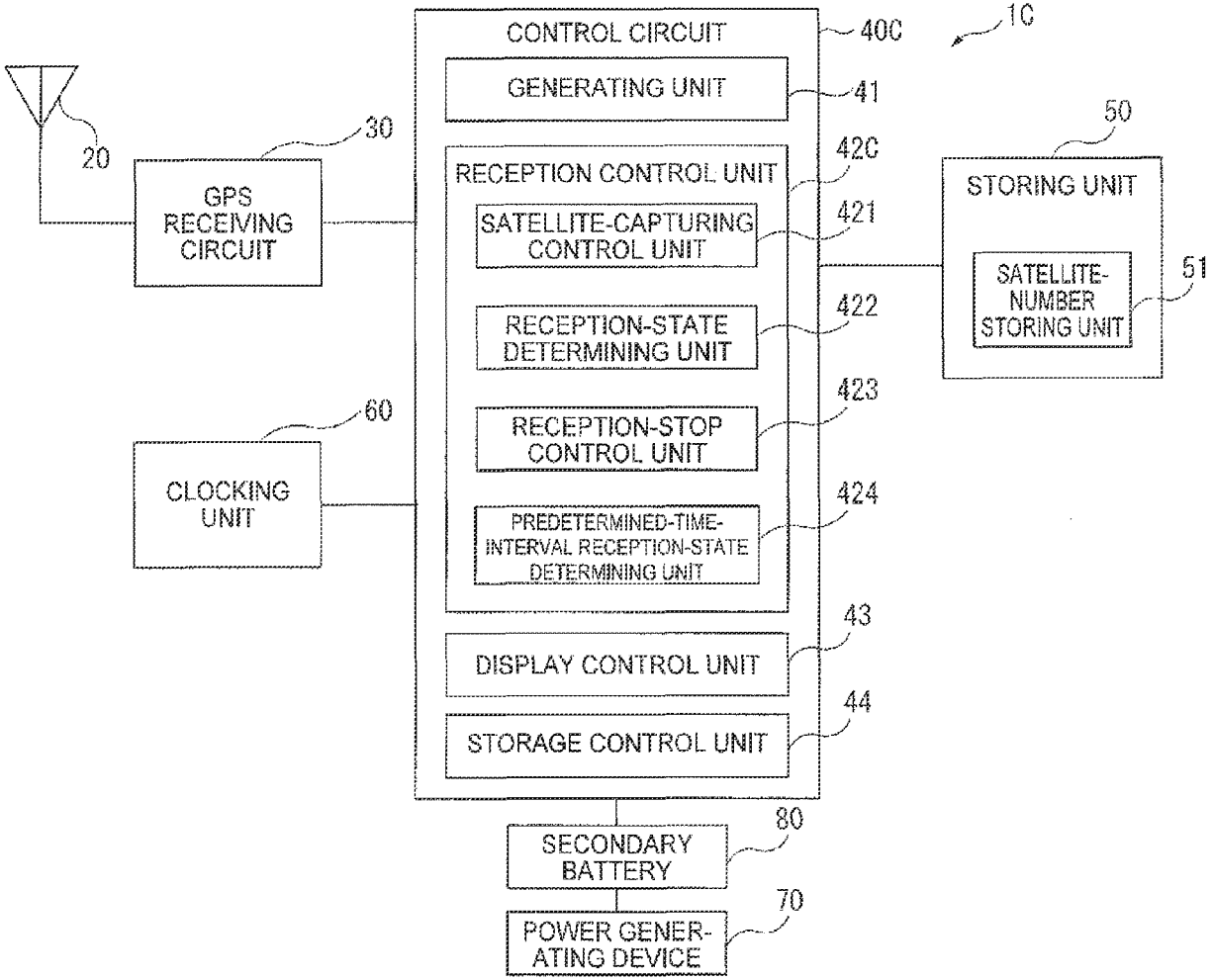
FIG. 12 is a block diagram showing a circuit configuration of an electronic timepiece in a third embodiment.

FIG. 12 is a block diagram showing a circuit configuration of an electronic timepiece of the third embodiment.

As shown in FIG. 12, a reception control unit 42C of an electronic timepiece 1C of the third embodiment includes a predetermined-time-interval reception-state determining unit (second reception-state determining unit) 424 in addition to the configuration of the reception control unit 42 of the electronic timepiece 1 of the first embodiment. The other configuration of the electronic timepiece 1C is the same as the configuration of the electronic timepiece 1.

The predetermined-time-interval reception-state determining unit 424 determines whether the number (the number of captured satellites) of GPS satellites 100 captured by the satellite-capturing control unit 421 is equal to or larger than a predetermined number at predetermined time intervals. Here, the number of captured satellites is the number of GPS satellites 100, signal reception levels of which are equal to or higher than a predetermined level. The predetermined level is set to a level which is slightly higher than the minimum threshold explained in the first embodiment. The predetermined number is, for example, three.

In this embodiment, when either of the reception-state determining unit (first reception-state determining unit) 422 and the predetermined-time-interval reception-state determining unit 424 determines that the number of captured satellites is smaller than the predetermined number, the reception-stop control unit 423 controls the GPS receiving circuit 30 to stop the reception of the satellite signals.

Figure 13:
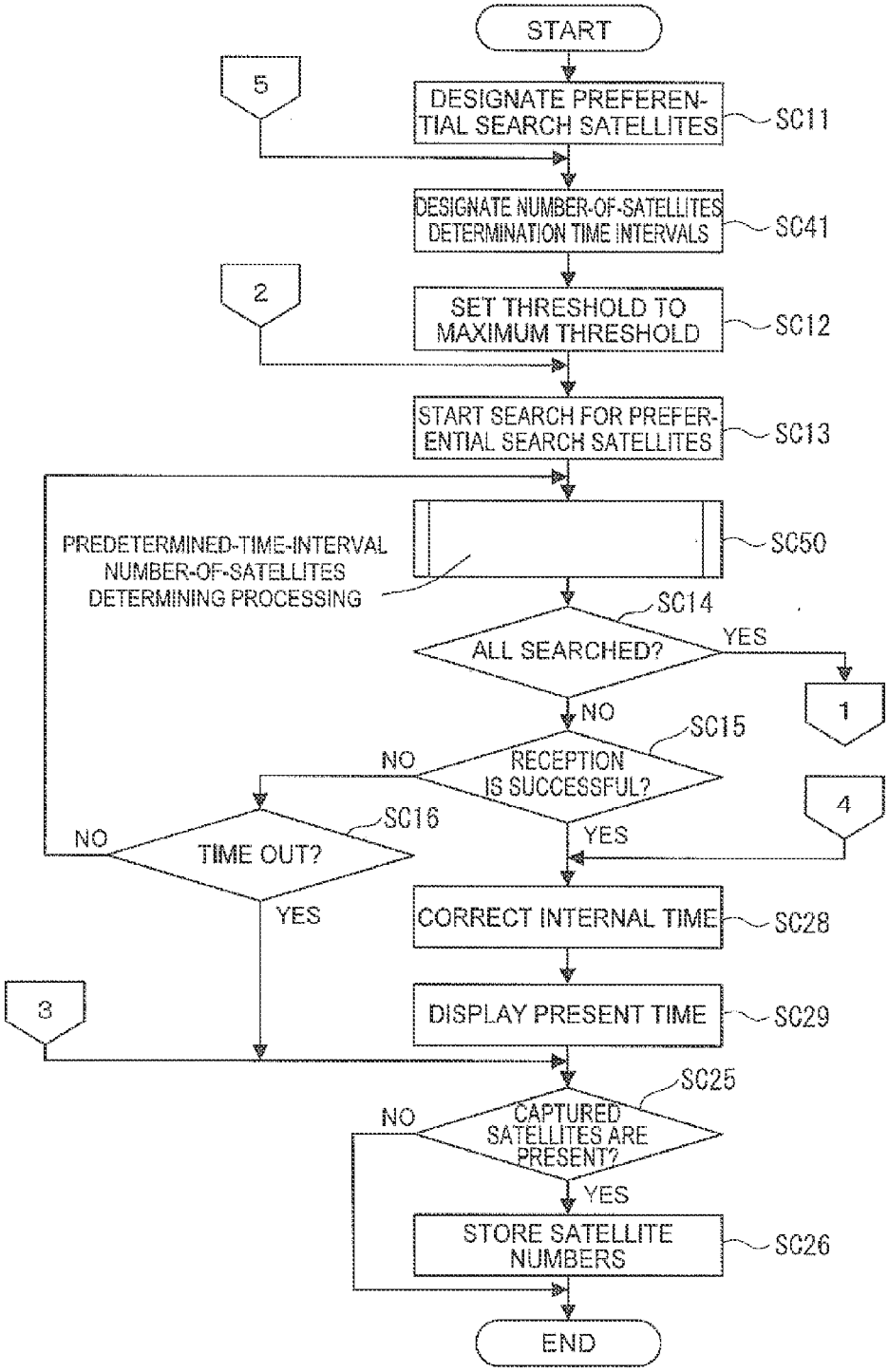
FIG. 13 is a flowchart for explaining reception processing in the third embodiment.
Figure 14:
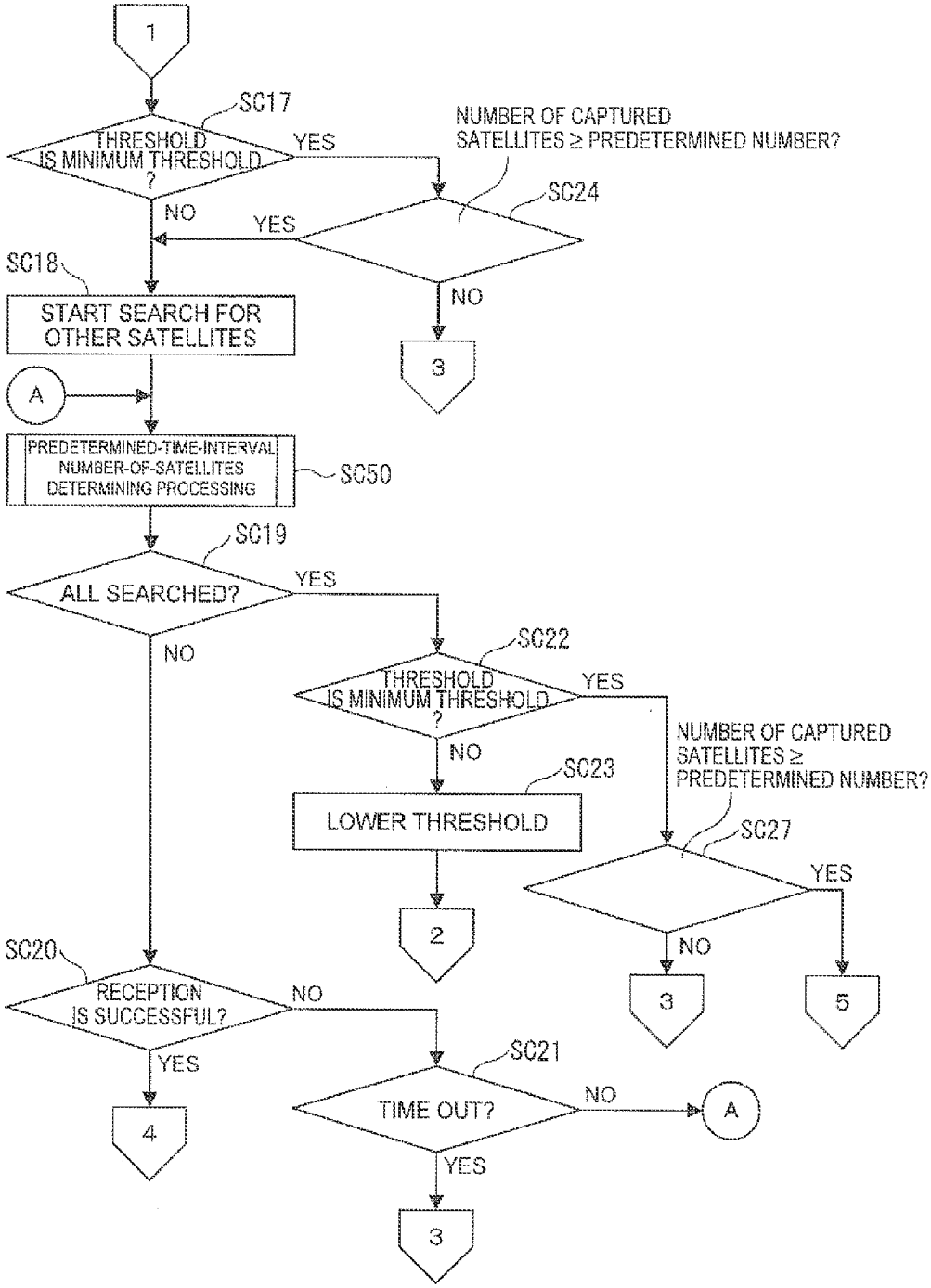
FIG. 14 is a flowchart for explaining reception processing in the third embodiment.

FIGS. 13 and 14 are flowcharts showing reception processing in the third embodiment.

The control circuit 40C performs processing in SC11 to SC29, SC41, and SC50 as shown in FIGS. 13 and 14. Processing in SC11 to SC29 is the same as the processing in SA11 to SA29 in the first embodiment. Therefore, explanation of the processing is omitted.

In the third embodiment, between processing in SC11 and processing in SC12, the predetermined-time-interval reception-state determining unit 424 designates time intervals for determining the number of captured satellites to predetermined time intervals (SC41). Consequently, number-of-satellites determination timing by the predetermined-time-interval reception-state determining unit 424 is set every predetermined time intervals after reception processing is started. In this embodiment, the predetermined time intervals are set so that initial number-of-satellites determination timing is set after timing of an end of the search for the preferential search satellites for which the threshold of the reception signal level is set to the minimum threshold and before timing of an end of the search for the other GPS satellites 100 for which the threshold is set to the minimum threshold.

In the third embodiment, between the processing in SC13 and the processing in SC14, the predetermined-time-interval reception-state determining unit 424 executes predetermined-time-interval number-of-satellites determining processing SC50. When it is determined No in SC16, the flow returns to the predetermined-time-interval number-of-satellites determining processing SC50.

Between processing in SC18 and processing in SC19, the predetermined-time-interval reception-state determining unit 424 executes the predetermined-time-interval number-of-satellites determining processing SC50. When it is determined No in SC21, the flow returns to the predetermined-time-interval number-of-satellites determining processing SC50.

Figure 15:
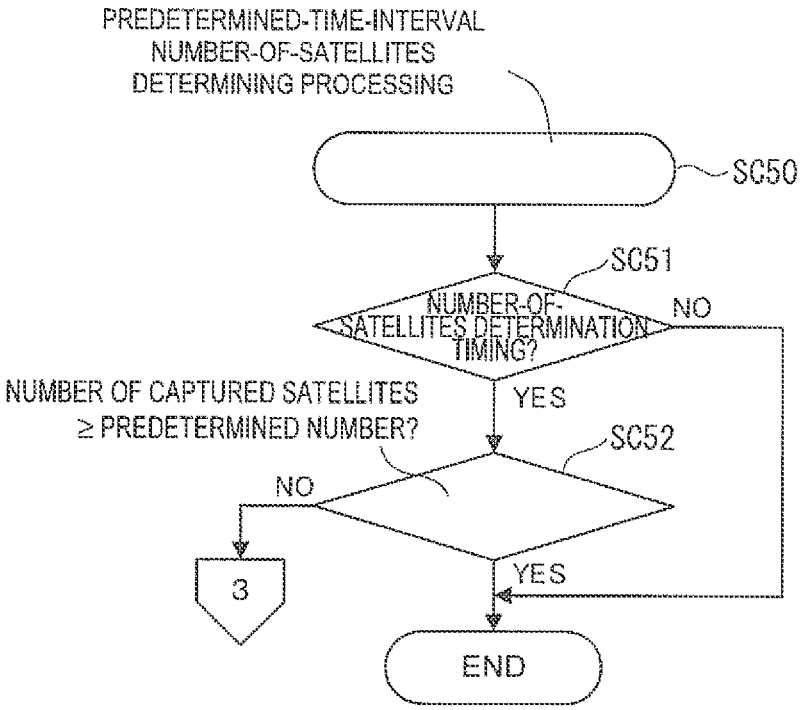
FIG. 15 is a flowchart for explaining predetermined-time-interval number-of-satellites determining processing in the third embodiment.

As shown in FIG. 15, in the predetermined-time-interval number-of-satellites determining processing SC50, the predetermined-time-interval reception-state determining unit 424 determines whether the number-of-satellites determination timing arrives (SC51).

When it is determined No in SC51, the predetermined-time-interval reception-state determining unit 424 finishes the predetermined-time-interval number-of-satellites determining processing SC50.

When it is determined Yes in SC51, the predetermined-time-interval reception-state determining unit 424 determines whether the number of captured satellites is equal to or larger than the predetermined number (SC52).

When it is determined Yes in SC52, the predetermined-time-interval reception-state determining unit 424 finishes the predetermined-time-interval number-of-satellites determining processing SC50.

On the other hand, when it is determined No in SC52, the predetermined-time-interval reception-state determining unit 424 advances the processing to SC25. Consequently, after processing in SC25 and SC26 is performed, the reception processing is ended.

Action and Effects of the Third Embodiment

When the reception-state determining unit 422 determines that the number of captured satellites is equal to or larger than the predetermined number (Yes in SC24) and the other GPS satellites 100 are currently searched at the timing of an end of the search for the preferential search satellites for which the threshold of the reception signal level is set to the minimum threshold, the predetermined-time-interval reception-state determining unit 424 determines whether the number of captured satellites is equal to or larger than the predetermined number (SC52) before the search for the other GPS satellites 100 ends, and the reception processing can be stopped when the number of captured satellites is smaller than the predetermined number.

For this reason, it is possible to prevent the reception processing from being continuously performed for a long period of time in a state in which reception of time information cannot be expected. Therefore, it is possible to further reduce power consumption.

Fourth Embodiment

A fourth embodiment of the invention is explained with reference to the drawings.

An electronic timepiece of the fourth embodiment is different from the electronic timepiece 1C of the third embodiment in that, when reception processing is manual reception processing, only determination by the predetermined-time-interval reception-state determining unit 424 is performed without performing determination by the reception-state determining unit 422.

Figure 16:
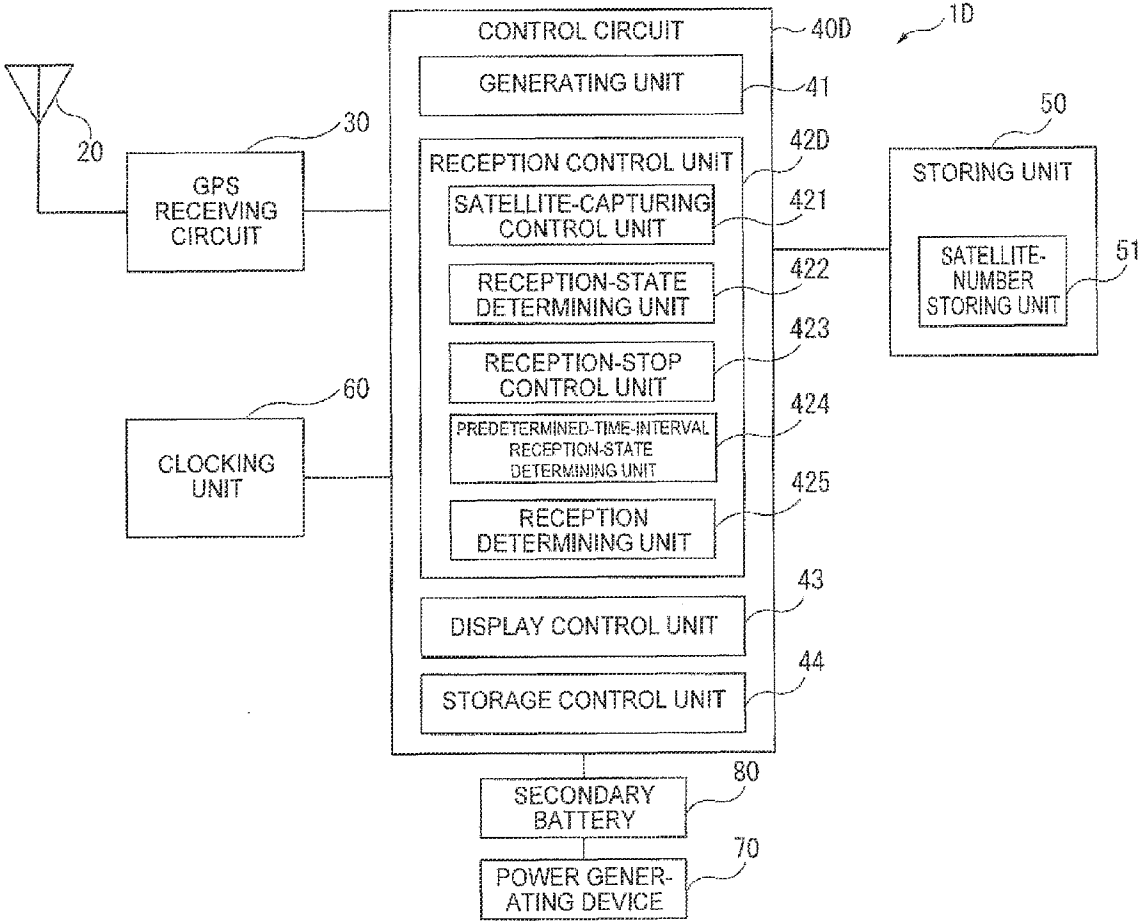
FIG. 16 is a block diagram showing a circuit configuration of an electronic timepiece in a fourth embodiment.

FIG. 16 is a block diagram showing a circuit configuration of an electronic timepiece of the fourth embodiment.

As shown in FIG. 16, a reception control unit 42D of an electronic timepiece 1D of the fourth embodiment includes a reception determining unit 425 in addition to the configuration of the reception control unit 42C of the electronic timepiece 1C of the third embodiment. The other configuration of the electronic timepiece 1D is the same as the configuration of the electronic timepiece 1C.

The reception determining unit 425 determines the type of reception processing performed by the reception control unit 42D. In this embodiment, the reception determining unit 425 determines whether the reception processing is automatic reception processing or manual reception processing.

The reception control unit 42D performs determination in either of the reception-state determining unit 422 and the predetermined-time-interval reception-state determining unit 424 or in both of the reception-state determining unit 422 and the predetermined-time-interval reception-state determining unit 424 according to the type of reception processing. In this embodiment, when the reception processing is automatic reception processing, determination is performed in both of the reception-state determining unit 422 and the predetermined-time-interval reception-state determining unit 424. When the reception processing is manual reception processing, determination is performed only in the predetermined-time-interval reception-state determining unit 424 without determination being performed in the reception-state determining unit 422.

Figure 17:
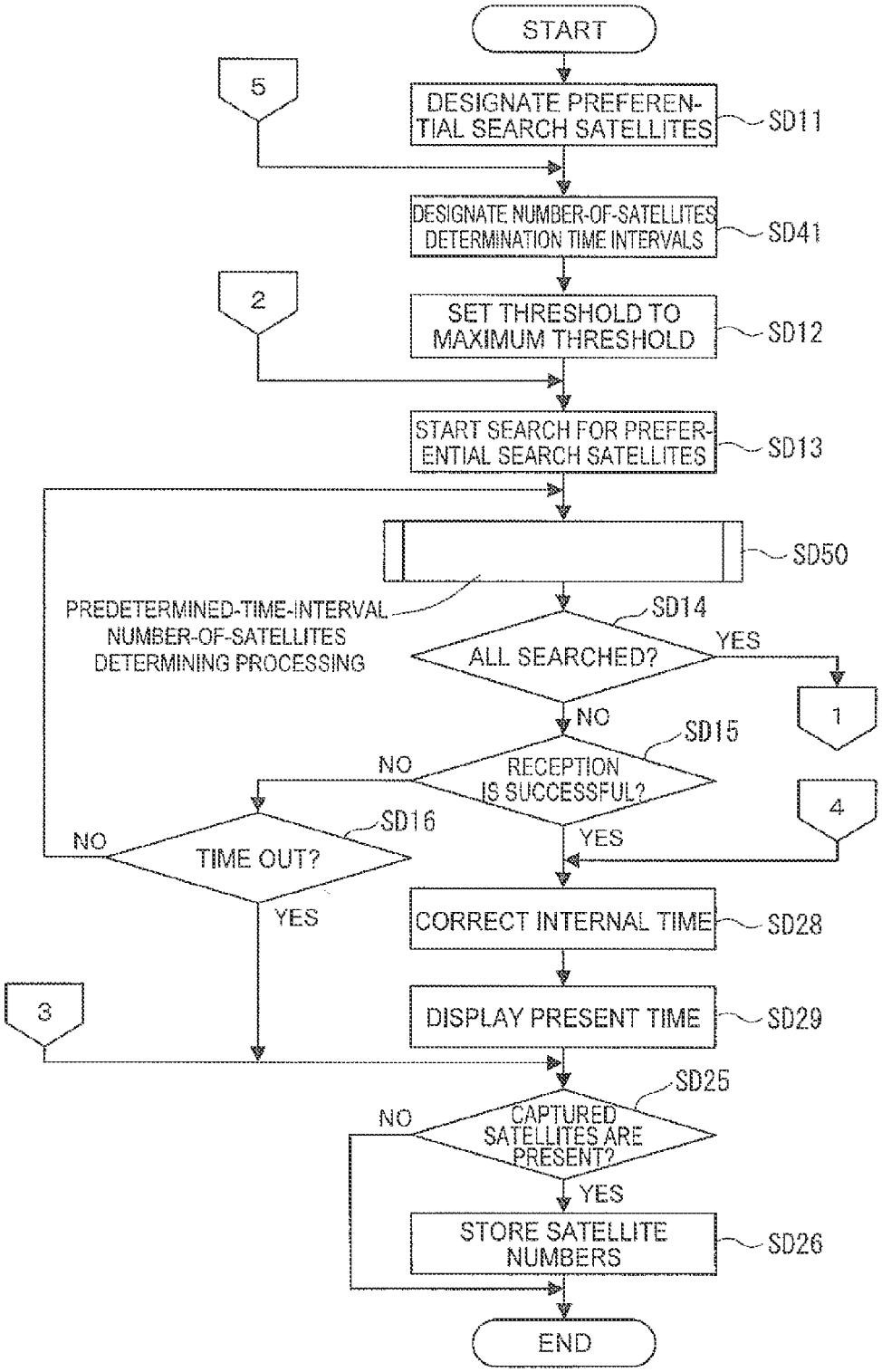
FIG. 17 is a flowchart for explaining reception processing in the fourth embodiment.
Figure 18:
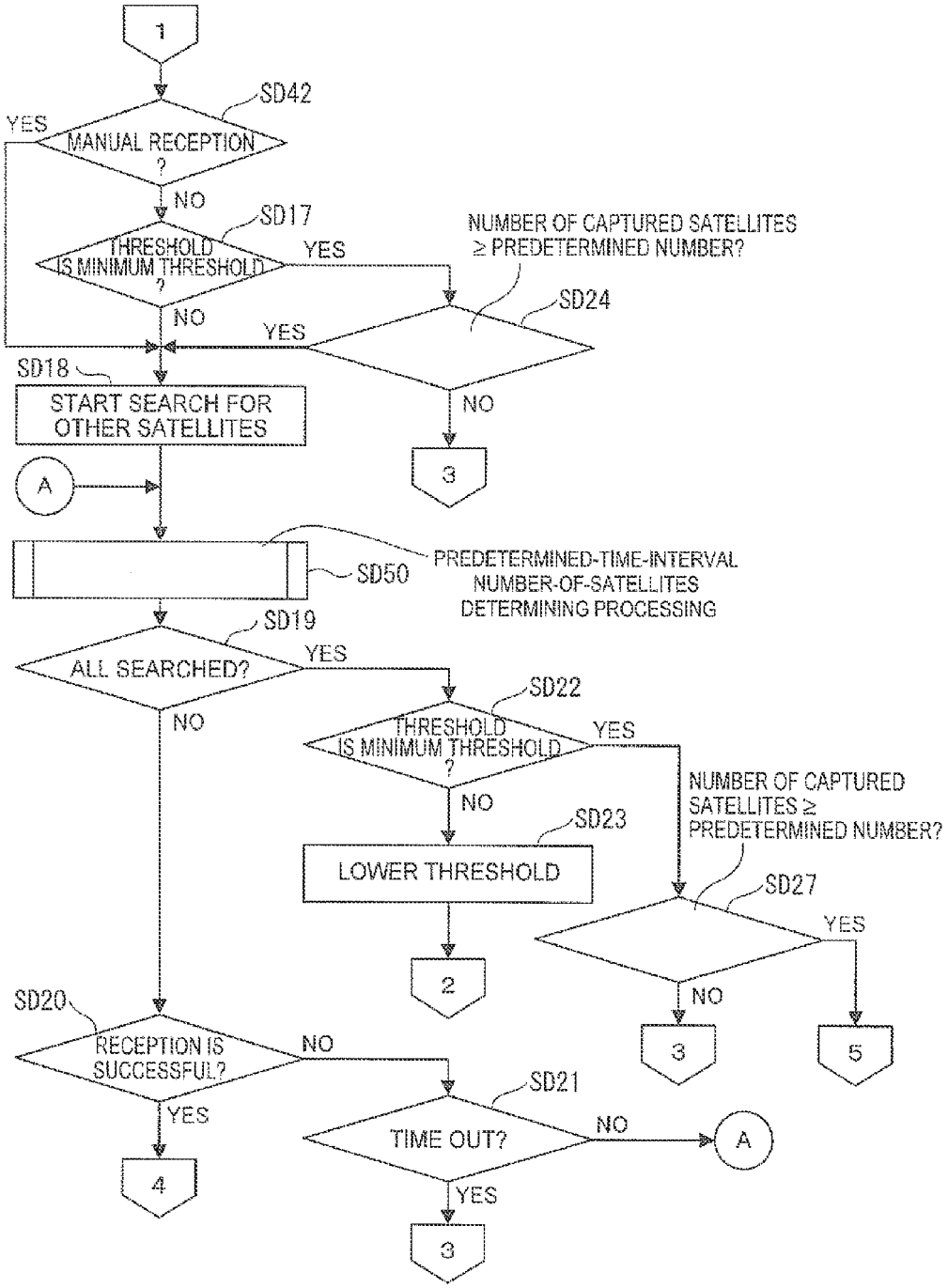
FIG. 18 is a flowchart for explaining reception processing in the fourth embodiment.

FIGS. 17 and 18 are flowcharts showing reception processing in the fourth embodiment.

The control circuit 40D performs processing in SD11 to SD29, SD41, SD42, and SD50 as shown in FIGS. 17 and 18. Processing in SD11 to SD29, SD41, and SD50 is the same as the processing in SC11 to SC29, SC41, and SC50 in the third embodiment. Therefore, explanation of the processing is omitted.

In the fourth embodiment, the reception determining unit 425 determines whether the reception processing performed by the reception control unit 42D is manual reception processing (SD42) after it is determined Yes in SD14 and before determination processing in SD17 is performed.

When it is determined No in SD42, the reception determining unit 425 advances the processing to SD17.

On the other hand, when it is determined Yes in SD42, the reception determining unit 425 advances the processing to SD18.

Action and Effects of the Fourth Embodiment

In the automatic reception processing, the reception-state determining unit 422 determines whether the number of captured satellites is equal to or larger than the predetermined number, and the reception processing is stopped when the number of captured satellites is smaller than the predetermined number. Therefore, it is possible to efficiently search for the GPS satellites 100 and thus to reduce power consumption. The predetermined-time-interval reception-state determining unit 424 performs the determination and thus it is possible to further reduce power consumption.

In the manual reception processing, the reception-state determining unit 422 does not perform determination at the timing of an end of the search for the preferential search satellites for which the threshold of the reception signal level is set to the minimum threshold (it is determined Yes in SD42, and the processing in SD24 is not performed). Therefore, the other GPS satellites 100 can be searched until at least the number-of-satellites determination timing by the predetermined-time-interval reception-state determining unit 424 arrives after searching for the preferential search satellites. For this reason, it is possible to improve a reception probability of time information.

As mentioned above, the determinations by the reception-state determining unit 422 and the predetermined-time-interval reception-state determining unit 424 are appropriately selected and performed according to the type of reception processing, and thus it is possible to improve a reception probability of time information while reducing a mean value of power consumption required for the reception processing.

Other Embodiments

Note that the invention is not limited to the configurations of the embodiments. Various modifications are possible within the scope of the gist of the invention.

For example, in the embodiments, in SA26, SB26, SB33, SC26, and SD26, the storage control unit 44 stores, in the satellite-number storing unit 51, the satellite numbers of the GPS satellites 100, reception signal levels of which are equal to or higher than the predetermined level, among the GPS satellites 100 captured by the satellite-capturing control unit 421.

However, the storage control unit 44 may store, in the satellite-number storing unit 51, the satellite numbers of a fixed number of the GPS satellites 100 counted from the GPS satellite 100 having a highest reception signal level among the GPS satellites 100 captured by the satellite-capturing control unit 421. The fixed number is, for example, four.

For example, it is assumed that nine GPS satellites 100 are captured by the satellite-capturing control unit 421 and the satellite numbers (PRNs) and the reception signal levels (SNRs) of the GPS satellites 100 are in a relation shown in FIG. 10A. In this case, four satellite numbers counted from the satellite number with the highest reception signal level shown in FIG. 10B are stored in the satellite-number storing unit 51.

Accordingly, the satellite-capturing control unit 421 preferentially searches for the GPS satellites 100 having high reception signal levels. Therefore, it is possible to efficiently capture the GPS satellites 100 having high reception success rates of the time information.

Consequently, it is possible to succeed in the reception of the time information earlier and further reduce power consumption.

In the embodiment, the satellite-capturing control unit 421 searches for the GPS satellites 100 having the satellite numbers stored in the satellite-number storing unit 51. However, in addition to the GPS satellites 100, the satellite-capturing control unit 421 may search for a quasi-zenith satellite (QZSS) such as "Michibiki".

The quasi-zenith satellite is a position information satellite that passes over Japan. The quasi-zenith satellite has a high reception success rate of the time information and the like in Japan. With this configuration, since the quasi-zenith satellite can also be captured, it is possible to improve the reception success rate of the time information in Japan.

Note that whichever of the search for the GPS satellites 100 and the search for the quasi-zenith satellite may be performed earlier. However, it is possible to acquire the time information early by searching for the quasi-zenith satellite having the high reception success rate of the time information first.

The electronic timepiece 1 may include a nonvolatile memory. A satellite number of the quasi-zenith satellite may be stored in the nonvolatile memory.

With this configuration, it is possible to store the satellite number of the quasi-zenith satellite even if electric power is not supplied. Therefore, it is possible to retain the satellite number even when a battery of the electronic timepiece 1 is exhausted (when a storage amount of the secondary battery 80 decreases to zero).

With this configuration, data rewriting is possible unlike, for example, a ROM (Read Only Memory). Therefore, when a quasi-zenith satellite is launched anew, it is possible to store a satellite number of the quasi-zenith satellite anew.

In the embodiments, in SA15, SA20, SB15, SB20, SC15, SC20, SD15, and SD20, the generating unit 41 receives the time information and determines whether the reception of the time information is successful. However, the generating unit 41 may receive information for positioning calculation and determine whether the reception of the information for positioning calculation is successful.

In this case, in SA28, SB28, SC28, and SD28, the internal time data is corrected by the received information for positioning calculation. In SA29, SB29, SC29, and SD29, a time zone corresponding to position information of the present location, which is a positioning result generated from the received information for positioning calculation, is displayed.

In this case, the time-out time in SA16, SA21, SB16, SB21, SC16, SC21, SD16, and SD21 is set to, for example, 120 seconds.

In the embodiments, the reception processing according to the invention is executed during the automatic reception processing and during the manual reception processing. However, during the manual reception processing, it is less likely that the preferential search satellites can be captured compared with during the automatic reception processing. Therefore, the reception processing may be executed only during the automatic reception processing. In this case, during the manual reception processing, the preferential search satellites are not searched preferentially to the other GPS satellites 100. All the GPS satellites 100 are searched in the order of the satellite numbers.

The reception processing according to the invention may be started when a predetermined time elapses after the automatic reception processing or the manual reception processing is started. For example, when leap second information is received, in some case, after reception is started, the time information is received, and transmission timing for the leap second information is calculated, the reception is once stopped and the reception is performed again awaiting the transmission timing for the leap second information. The reception processing may be executed at timing when the reception is performed again.

In the embodiments, the search for the GPS satellites 100 is performed with the threshold of the signal reception level set to the maximum threshold, the intermediate threshold, and the minimum threshold. However, for example, the threshold may be set to the maximum threshold and the minimum threshold or may be set to the minimum threshold.

In the embodiments, the search for the preferential search satellites is performed according to the order of the satellite numbers. However, the reception signal levels may be stored in the satellite-number storing unit 51 together with the satellite numbers. The preferential search satellites may be searched in order from the preferential search satellite having the highest reception signal level with reference to the reception signal levels. Consequently, it is possible to capture the GPS satellites 100 having high reception signal levels early and succeed in the reception of the time information earlier.

In the embodiments, the satellite numbers of the captured GPS satellites 100 are stored in the satellite-number storing unit 51 irrespective of whether the reception of the time information is successful. However, the satellite numbers may be stored only when the reception is successful and may be not stored when the reception is unsuccessful.

In the embodiments, when the captured GPS satellites 100 are UnHealth satellites, the satellite numbers do not have to be stored in the satellite-number storing unit 51.

In the embodiments, both during the automatic reception processing and during the manual reception processing, the satellite numbers of the captured GPS satellites 100 are stored in the satellite-number storing unit 51. However, the GPS satellites 100 captured during the manual reception processing are less likely to be captured in the next automatic reception processing than the GPS satellites 100 captured during the automatic reception processing. Therefore, the satellite numbers of the captured GPS satellites 100 may be stored only during the automatic reception processing and may be not stored during the manual reception processing.

During the manual reception processing, the satellite numbers of the captured GPS satellites 100 may be additionally stored without being overwritten in the satellite-number storing unit 51. Consequently, it is possible to supplementarily add the captured GPS satellites 100 to the preferential search satellites during the manual reception processing.

In the embodiments, the GPS satellites 100 are explained as an example of the position information satellites. However, the position information satellites according to the invention is not limited to the GPS satellites 100 and may be other global navigation satellite systems (GNSS) such as Galileo (EU), GLONASS (Russia), and Beidou (China), stationary satellites of a stationary satellite type satellite navigation reinforcement system (SBAS) and the like, and the quasi-zenith satellite.

FIG. 11 is a list of satellite numbers of the position information satellites. As shown in the figure, as the satellite numbers, different numbers are given to the GPS satellites 100, the satellites of SBAS, and the quasi-zenith satellite. Therefore, it is possible to store the satellite numbers in the satellite-number storing unit 51 in a mixed state.

In the third embodiment, the predetermined time intervals are set so that the predetermined-time-interval reception-state determining unit 424 performs initial determination after an end of the search for the preferential search satellites for which the threshold of the reception signal level is set to the minimum threshold. However, the invention is not limited thereto.

For example, the predetermined time intervals may be set so that the initial determination is performed after an end of the search for the preferential search satellites for which the threshold is set to a maximum threshold or an intermediate threshold.

In the fourth embodiment, when the reception processing is the automatic reception processing, the determination is performed in both of the reception-state determining unit 422 and the predetermined-time-interval reception-state determining unit 424. However, the invention is not limited thereto. For example, the determination may be performed only in the reception-state determining unit 422 in the same manner as in the reception processing of the first embodiment.

In the fourth embodiment, the reception determining unit 425 determines whether the reception processing is the automatic reception processing or the manual reception processing. When the reception processing is the automatic reception processing, the reception control unit 42D performs determination in both of the reception-state determining unit 422 and the predetermined-time-interval reception-state determining unit 424. When the reception processing is the manual reception processing, the reception control unit 42D performs determination only in the predetermined-time-interval reception-state determining unit 424 without performing determination in the reception-state determining unit 422. However, the invention is not limited thereto.

For example, the reception determining unit 425 may determine whether the reception processing is regular automatic reception processing or photo-automatic reception processing. When the reception processing is the regular automatic reception processing, the reception control unit 42D may perform determination in both of the reception-state determining unit 422 and the predetermined-time-interval reception-state determining unit 424. When the reception processing is the photo-automatic reception processing, the reception control unit 42D may perform determination only in the predetermined-time-interval reception-state determining unit 424 without performing determination in the reception-state determining unit 422 in the same manner as in the manual reception processing in the fourth embodiment.

The entire disclosure of Japanese Patent Application Nos. 2013-185489, filed Sep. 6, 2013 and 2014-159744, filed Aug. 5, 2014 are expressly incorporated by reference herein.

What is claimed is:

1. An electronic timepiece comprising:

a receiving unit configured to execute a reception processing that captures position information satellite and receives satellite signal transmitted from the captured position information satellite;

a satellite-number storing unit configured to store satellite number of position information satellite; and a reception control unit configured to control the receiving unit, wherein the reception control unit includes:

a satellite-capturing control unit configured to search for a preferential search satellite more preferentially than the other position information satellites, the preferential search satellite being the position information satellite having the satellite number stored in the satellite-number storing unit;

a reception-state determining unit configured to determine, at timing of an end of the search for the preferential search satellite, whether a number of the captured position information satellites is equal to or larger than a predetermined number;

a reception-stop control unit configured to stop the reception processing when the reception-state determining unit determines that the number of the position information satellites is smaller than the predetermined number; and a storage control unit configured to store the satellite number of the captured position information satellite in the satellite-number storing unit.

2. The electronic timepiece according to claim 1, wherein the satellite-capturing control unit can set a threshold of a reception signal revel to a first threshold or a second threshold when searching, the reception-state determining unit determines the number of the captured position information satellites when the threshold is set to the second threshold.

3. The electronic timepiece according to claim 2, wherein the second threshold has a value lower than the first threshold, the satellite-capturing control unit sets, after setting the threshold to the first threshold and searching for the position information satellites, the threshold to the second threshold, and the reception-state determining unit determines, at timing when the search for the preferential search satellite ends in the search in which the threshold is set to the second threshold, whether the captured number of the position information satellites is equal to or larger than the predetermined number.

4. The electronic timepiece according to claim 1, wherein the storage control unit stores, in the satellite-number storing unit, the satellite numbers of the position information satellites having reception signal levels equal to or higher than a predetermined level among the captured position information satellites.

5. The electronic timepiece according to claim 1, wherein the storage control unit stores, in the satellite-number storing unit, the satellite numbers of a fixed number of the position information satellites counted from the position information satellite having a highest reception signal level among the captured position information satellites.

6. The electronic timepiece according to claim 1, wherein the storage control unit stores, in the satellite-number storing unit, at end timing of the reception processing, the satellite number of the captured position information satellite.

7. The electronic timepiece according to claim 1, wherein the storage control unit stores, during a fixed time in the reception processing, in the satellite-number storing unit, the satellite number of the captured position information satellite.

8. The electronic timepiece according to claim 1, wherein the satellite-capturing control unit searches for a quasi-zenith satellite in addition to the position information satellite having the satellite number stored in the satellite-number storing unit.

9. The electronic timepiece according to claim 8, further comprising a nonvolatile memory, wherein a satellite number of the quasi-zenith satellite is stored in the nonvolatile memory.

10. An electronic timepiece comprising:

a receiving unit configured to execute a reception processing that captures position information satellite and receive satellite signal transmitted from the captured position information satellite;

a satellite-number storing unit configured to store satellite number of position information satellite;

and a reception control unit configured to control the receiving unit, wherein the reception control unit includes:

a satellite-capturing control unit configured to search for a preferential search satellite more preferentially than the other position information satellites, the preferential search satellite being the position information satellite having the satellite number stored in the satellite-number storing unit;

a first reception-state determining unit configured to determine, at timing of an end of the search for the preferential search satellites, whether a number of the captured position information satellite is equal to or larger than a predetermined number;

a second reception-state determining unit configured to determine whether a number of the captured position information satellite is equal to or larger than a predetermined number at predetermined time intervals;

a reception-stop control unit configured to stop the reception processing when either of the first reception-state determining unit and the second reception-state determining unit determines that the number of the captured position information satellite is smaller than the predetermined number; and a storage control unit configured to store the satellite number of the captured position information satellite in the satellite-number storing unit.

11. The electronic timepiece according to claim 10, further comprising an input unit, wherein the reception processing includes automatic reception processing for receiving the satellite signals when an automatic reception condition occurs and manual reception processing for receiving the satellite signals according to an operation of the input unit, and the reception control unit determines whether a number of the captured position information satellites is equal to or larger than a predetermined number in either of the first reception-state determining unit and the second reception-state determining unit or in both of the first reception-state determining unit and the second reception-state determining unit according to the type of reception processing.

12. A satellite signal receiving method of an electronic timepiece including:

a receiving unit configured to execute a reception processing that captures position information satellite and receives satellite signal transmitted from the captured position information satellite;

a satellite-number storing unit configured to store satellite number of position information satellite; and a reception control unit configured to control the receiving unit, the satellite signal receiving method comprising:

searching for a preferential search satellite more preferentially than the other position information satellites, the preferential search satellite being the position information satellite having the satellite number stored in the satellite-number storing unit;

determining, at timing of an end of the search for the preferential search satellites, whether a number of the captured position information satellites is equal to or larger than a predetermined number;

stopping the reception processing when it is determined that the number of the captured position information satellite is smaller than the predetermined number; and storing the satellite number of the captured position information satellite in the satellite-number storing unit.

* * * * *